US005955687A

United States Patent [19]

Miyagi et al.

[11] Patent Number: 5,955,687

[45] Date of Patent: Sep. 21, 1999

[54] DISC MUSIC BOX, INFORMATION DISC THEREFOR, AND TRICK TIMEPIECE WITH DISC MUSIC BOX

[75] Inventors: Shigeru Miyagi; Norihiko Nakamura, both of Saitama, Japan

[73] Assignee: Rhythm Watch Co., Ltd., Tokyo, Japan

[21] Appl. No.: 08/841,386

[22] Filed: Apr. 30, 1997

[30] Foreign Application Priority Data

| | | | |
|---|---|---|---|
| Apr. 30, 1996 | [JP] | Japan | 8-109266 |
| Nov. 28, 1996 | [JP] | Japan | 8-317769 |
| Jan. 31, 1997 | [JP] | Japan | 9-18427 |
| Feb. 4, 1997 | [JP] | Japan | 9-21399 |

[51] Int. Cl.[6] ..... G10F 1/06

[52] U.S. Cl. ..... 84/97; 84/97; 84/98

[58] Field of Search ..... 84/97, 98, 101, 84/94.2

[56] References Cited

U.S. PATENT DOCUMENTS

| | | | |
|---|---|---|---|
| 2,557,061 | 6/1951 | Goldman | 84/97 |
| 3,244,052 | 4/1966 | Stubbmann | 84/97 |
| 3,379,084 | 4/1968 | Ryan et al. | 84/97 |
| 3,535,973 | 10/1970 | Rosen | 84/102 |
| 3,559,525 | 2/1971 | Fishbein | 84/94 |
| 3,706,156 | 12/1972 | Thornell | 84/97 |
| 3,750,520 | 8/1973 | Inoue | 84/94 |
| 4,313,361 | 2/1982 | Deutsch | 84/1.01 |
| 4,466,328 | 8/1984 | Kitamura | 84/98 |
| 5,119,932 | 6/1992 | Semanoff | 206/114 |
| 5,418,319 | 5/1995 | Akiyama | 84/83 |
| 5,698,801 | 12/1997 | Meng-Suen | 84/101 |

*Primary Examiner*—William M. Shoop, Jr.
*Assistant Examiner*—Kim Lockett
*Attorney, Agent, or Firm*—Kanesaka & Takeuchi

[57] ABSTRACT

A disc music box for playing a melody, which comprises a disc (3) having a plurality of engaging parts (4, 40), a motor (M) for rotating the disc, and star wheels (12) guided and rotated by the engaging parts of the rotating disc for plucking music box petals (17a), wherein control information for controlling other instruments to be operated in association with the play of the music box is recorded at desired portions on the disc excepting portions where the engaging parts are disposed on the disc. An information disc (101) has both playing and control information and is driven to rotate at a predetermined speed. A tricky timepiece comprises a disc music box instrument (120) to which a music box disc (101) is attached and a tricky device (150) interconnected with the disc music box instrument to move puppets (151), thereby providing tricky performance. The term "tricky" is defined as mechanized movements designed to amuse or impress.

19 Claims, 26 Drawing Sheets

DISC MUSIC BOX, INFORMATION DISC THEREFOR, AND TRICK TIMEPIECE WITH DISC MUSIC BOX

BACKGROUND OF THE INVENTION

1. Field of the Invention

The invention relates to a disc music box in which a disc having a plurality of engaging parts for playing is rotated by a motor and star wheels which are guided by the engaging parts for playing are rotated to pluck music box petals to play a melody, and particularly to recording on the disc of control information for controlling an instrument related to the play of the music box and controlling the equipment directly or in parallel in association with the play of the music box.

The invention also relates to controlling of a trick or animated timepiece in association with the play of the music box, which trick or animating timepiece has a trick mechanism incorporated therein and a disc music box mounted thereon. The term "tricky or animated" means mechanized movements designed to amuse or impress as described in more detail hereinafter.

2. Description of the Related Art

Generally known sounding means used for a time signal of a timepiece or the like is not limited to one which produces an inorganic electronic sound by a sounding circuit and a loud speaker, but also one which produces a conventional soft music box's sound by a mechanical music box instrument.

Such a music box instrument generally plays a previously provided single music number and comprises music box sounding prongs in a strip shape with a plurality of sounding parts corresponding to the number of musical intervals, a barrel which is disposed to oppose the music box sounding prongs and provided with pins protruded at appropriate positions on the outer periphery of the barrel to pluck the sounding parts of the sounding prongs with predetermined playing timing, and a drive unit for rotating the barrel at a predetermined speed.

Specifically, the sounding prongs have a substantially oblong metal plate formed in the shape of comb teeth which have the sounding parts corresponding to the number of musical intervals, and these comb teeth (music box petals) have a predetermined length and thickness to have specific pitches to make allotted music box sounds when the tips of the music box petals are plucked. The barrel is formed in a cylinder longer than at least the sounding prongs, disposed to be rotatable and to face the sounding parts of the sounding prongs, and formed intermittent pins corresponding to a music number and protruded from the outer periphery of the barrel which is opposed to the sounding parts of the sounding prongs. And, the drive unit drives to rotate the barrel in a predetermined direction at a given speed, and the respective pins of the barrel pluck the respective sounding parts of the sounding prongs with predetermined timing to play a music number.

Another music box instrument has been proposed which is provided instead of the barrel with a circular plate-shaped music box disc having engaging and driving parts for sounding and driving the respective sounding parts of the sounding prongs, and the music box disc can be changed to play a desired music number. The music box disc of the above music box instrument is a metal disc, its one side is divided into a plurality of tracks corresponding to the music box petals of the music prongs, and the engaging and driving units are formed at a position in a circumferential direction corresponding to the playing timing of musical intervals allotted by the tracks. These engaging and driving parts comprise pins protruded from one side of the music box disc and holes having a predetermined diameter. And, the predetermined parts of the sounding prongs are plucked by these engaging and driving parts to play a music box.

The music box having the music box disc includes a circular plate-shaped music box disc having multiple engaging and driving parts to play music, the music box disc is driven to rotate by a drive mechanism of the music box body. And, the music box body has star wheels for plucking the music box petals of the sounding prongs mounted to be rotatable on a star wheel shaft. And, when the music box disc is rotated by the drive mechanism, the engaging and driving parts of the music box disc engage with picks of the star wheels which correspond to the engaging and driving parts to rotate the star wheels, and the music box petals are plucked by other picks which are subsequent to the rotating star wheels to produce music box sounds to play a melody.

This disc music box holds the music box disc at a position opposed to the star wheels by pushing from one side by a music box disc holding arm which is provided with a holding roller, so that a relatively thin music box disc can be used. Therefore, music box discs having different patterned music numbers formed can be produced in a large number inexpensively, easily stored and managed easily because they are thin, and transported efficiently.

In addition, since the music box discs are handled with ease, they can be attached to or removed from the music box readily and exchanged in a short time. Therefore, when a plurality of music box discs for different music numbers are provided in advance and a music box disc is changed to another disc for a desired music number, a music number to be played can be changed quickly and with ease.

As described above, the disc music box is easy to mount a desired music box disc by selecting from a plurality of music box discs as compared with the music box provided with a stationary barrel for a single music only. It has an advantage that music numbers can be changed flexibly and easily in accordance with a taste of the user. When this disc music box is desired to be operated in association with another instrument, a time chart is generally provided in advance, and the play of the music box and the operation of the instrument are controlled according to the time chart.

For example, a trick timepiece which does tricks at predetermined time starts playing the music box according to the previously provided time chart and controls the operation of the related instrument such as a puppet with timing recorded in the time chart. Therefore, when a structure is simple, the operation of the instrument may not change even when the music number is changed. Such a trick timepiece has disadvantages that flexible control cannot be made depending on music numbers, and its circuit structure is too complex to be applied for a small-scale trick timepiece for home use.

To use sound holes to control the instrument, namely to directly get control signals for respective instruments from a sounding pattern, the music scales of a music number are determined to produce the control signal, and the circuit structure is made complex. In any event, since the instrument is indirectly controlled to play the music box, it is hard to control the instrument in detail, and the circuit structure is made complex.

In view of the above-described circumstances, the invention has been completed to provide a disc music box which has information for controlling an associated instrument recorded on a play information free portion of a disc or on a specific portion of the engaging parts for playing. And, to operate in association with another instrument, the above music box instrument is provided with a time chart in advance, and the play of the music box and the operation of the instrument are controlled according to the time chart. In other words, a trick timepiece which does tricks at predetermined time starts playing the music box according to the previously provided time chart and controls the operation of the associated instrument such as the puppet with the timing recorded in the time chart. Therefore, when a structure is simple, the operation of tricks by the instrument remains same even when the music number is changed, resulting in attracting poor interest. And, such a trick timepiece has disadvantages that flexible control is hardly made depending on music numbers, and its circuit structure is too complex to be applied for a compact trick timepiece for home use.

Besides, to use sound holes to control the instrument, namely to directly get control signals for respective instruments from a sounding pattern, the music scales of a music number are determined to produce the control signal, and the circuit structure is made complex. In any event, since the instrument is indirectly controlled to play the music box, it is hard to control the instrument in detail, and the circuit structure is made complex.

SUMMARY OF THE INVENTION

In view of the above circumstances, the present invention aims to provide an information disc which allows to operate to produce actual sounds and to obtain a control signal related to or synchronous with the sounding operation and also an output device for the information disc.

Generally, the trick timepieces are known that a trick device such as a puppet which is normally concealed within the timepiece appears outside of the timepiece and plays actions on the hour (such as one o'clock or two o'clock, when the minute hand of a timepiece points "12"), and include various types such as small table and wall clocks used indoors and large clocks which are mounted on building walls and independent towers.

These trick timepieces have a stage for the tricky device faced in a predetermined direction, and the puppet or the like appears on the stage at a fixed time. The tricky device has various types of motions, namely a door opens and a puppet comes out; the puppet moves in addition and the motion is in vertical and horizontal directions; various melodies are played at the same time and other sound effects are provided; or the puppet is lighted up. Thus, these large and small trick timepieces are provided with various moving modes.

The above-described trick timepieces often produce electronic sounds from a loud speaker when trick motions are being performed, but such sounds are similar to those of electronic toys and poor in grace of handicrafts. Thus, an upscale image cannot be obtained. Since melodies used to accompany the trick motions are generally stored in a melody IC, they are fixed in advance. Even if a plurality of music numbers are stored so that the user can select a desired music number, the selection is limited to the stored music numbers, and a cost may be increased. And, there has not been proposed any trick timepiece which is provided with a disc music box instrument which uses exchangeable discs.

Therefore, the present invention provides a trick timepiece which can operate a music box to play music in association with trick motions.

The invention relates to a disc music box for playing a melody by rotating a disc having a plurality of engaging parts for playing by a motor and plucking music box petals by star wheels guided and turned by the engaging parts for playing, wherein control information for controlling other instruments to be moved in association with the play of the music box is recorded at desired portions of the disc excepting portions where the engaging parts for playing are disposed on the disc.

And, the invention relates to such a disc music box, wherein a single or a plurality of engaging parts are specified among the engaging parts for playing on the disc, and the specified engaging part(s) for playing is used as a medium for recording control information for controlling other instruments to be moved in association with the play of the music box.

Thus, since recording parts which have information for controlling the associated instruments are formed on the disc to directly control the associated instruments as the music box plays, the instruments can be controlled directly and in parallel in association with the music box's play, and a circuit configuration can be simplified. And, control information for a different instrument can be recorded on every disc and the disc can be exchanged readily, so that not only music numbers but also instrument operations can be changed flexibly depending on situations. For example, by providing discs having the same music number but different control information in advance, the interconnected instrument can be motioned in a different way quickly and readily with the same music number played by simply changing the discs.

The invention relates to an information disc which has both playing information and control information and is driven to rotate at a predetermined speed, wherein the playing information is information which is a source to produce sounds from an output device, formed of engaging parts for playing which are disposed on playing tracks of at least the number of musical scales, and the control information is information which is used to control other instruments by an output control device and formed by disposing information tracks corresponding to at least the number of instruments and forming engaging parts for information on the information tracks.

Thus, the playing tracks where the engaging parts for playing and the information tracks where the engaging parts for information of the instruments associated with the playing are disposed on the same information disc, and the associated instruments can be controlled in association with the play, so that the circuit configuration can be simplified. Besides, the operation of the instrument can be followed automatically even when the rotating speed of the disc rotating to play, namely the rhythm of a music number, is changed. And, control information for a different instrument can be recorded on every disc and the disc can be exchanged readily, so that not only music numbers but also instrument operations can be changed flexibly depending on situations. For example, by providing discs having the same music number but different control information in advance, the interconnected instrument can be made quickly and readily to motion in a different way with the same music number played by simply changing the discs.

Furthermore, the invention relates to an output device for an information disc which has a sounding mechanism to obtain playing information of the information disc to operate to produce sounds and a contact mechanism to obtain control information of the information disc to output outside, the output device on which the information disc is mounted is characterized in that the sounding mechanism plays a melody by plucking music box petals of music box sounding member by star wheels which are guided to rotate by the engaging parts for playing; and the contact mechanism is operated to contact by the star wheels which are guided to rotate by engaging parts for information.

Thus, the playing information and the control information written on the information disc is materialized by the sounding mechanism which plays a melody by plucking the music box petals of music box sounding member by the star wheels which are guided to rotate by the engaging parts for playing and the contact mechanism which is operated to contact by the star wheels which are guided to rotate by the engaging parts for information.

In addition, the invention relates to a trick timepiece having a tricky device which performs tricky movements disposed within a clock body, wherein a disc music box to which a music box disc is detachably fitted is disposed within the clock body, and the tricky movements of the tricky device are interconnected with the operation of the disc music box. The trick timepiece of the invention can give more fun to the user by incorporating the disc music box to associate the tricky movements of the tricky device and the play of the disc music box to use the music box's play of actual sounds rich in realism as accompaniment of the tricky movements.

Thus, in addition to the use as the normal timepiece, this trick timepiece of the invention can secure the sufficient appearance of a handicraft, and have a high-quality appearance. A commodity value can be improved, and various developments can be made as commodity.

DESCRIPTION OF THE PREFERRED EMBODIMENT

Embodiments of the invention will be described with reference to FIG. 1 to FIG. 12. The basic structure of a disc music box to be described below is common through the subsequent embodiments. Therefore, description of the disc music boxes in the respective embodiments will not be repeated.

Figure 1:
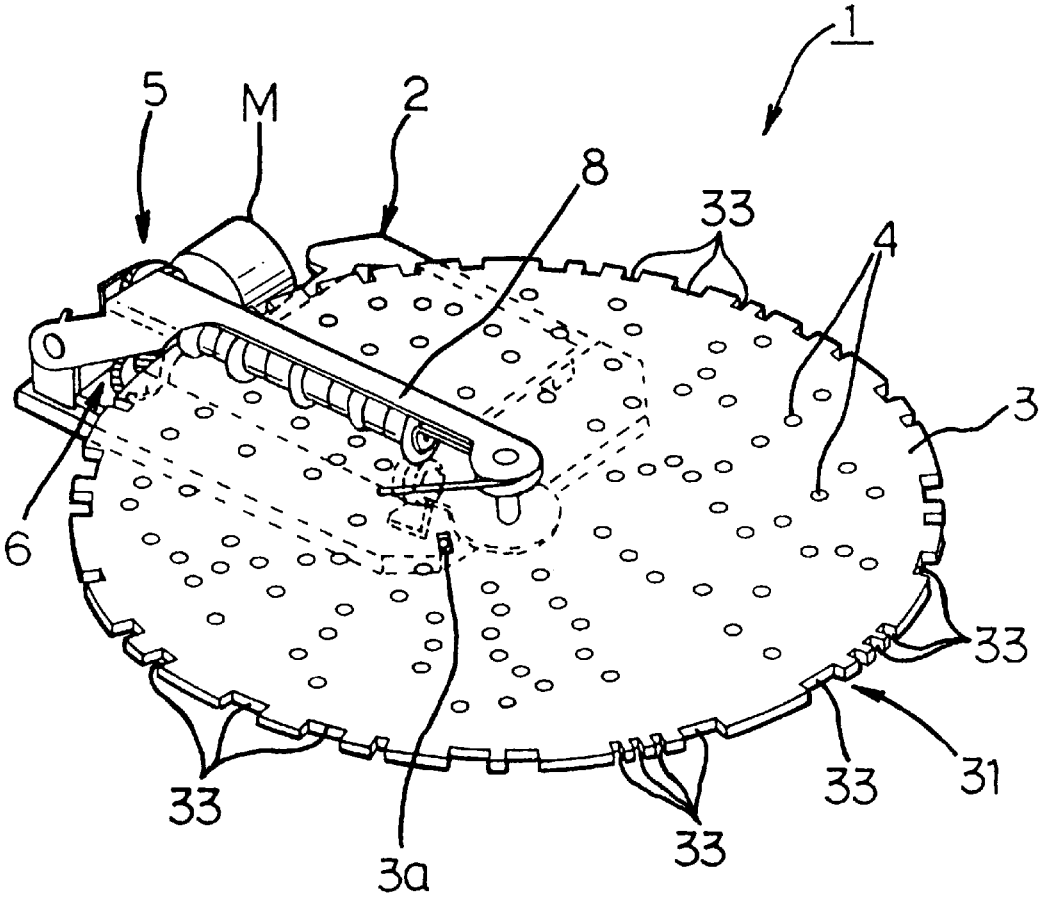
FIG. 1 is an external perspective view showing a schematic entire structure of the disc music box of the invention.
Figure 2:
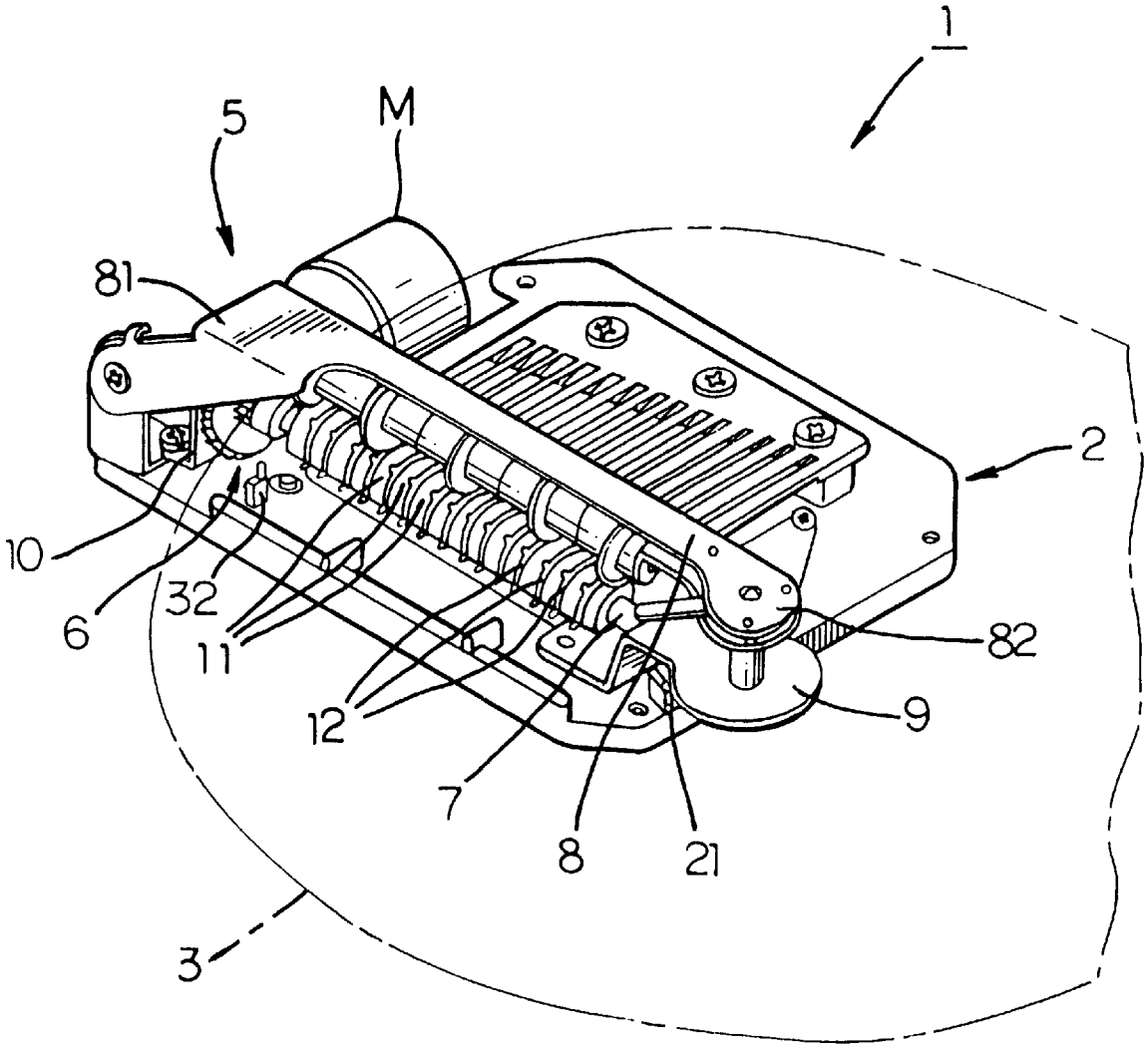
FIG. 2 is an external perspective view showing a state without a disc related to the disc music box of the invention.
Figure 3:
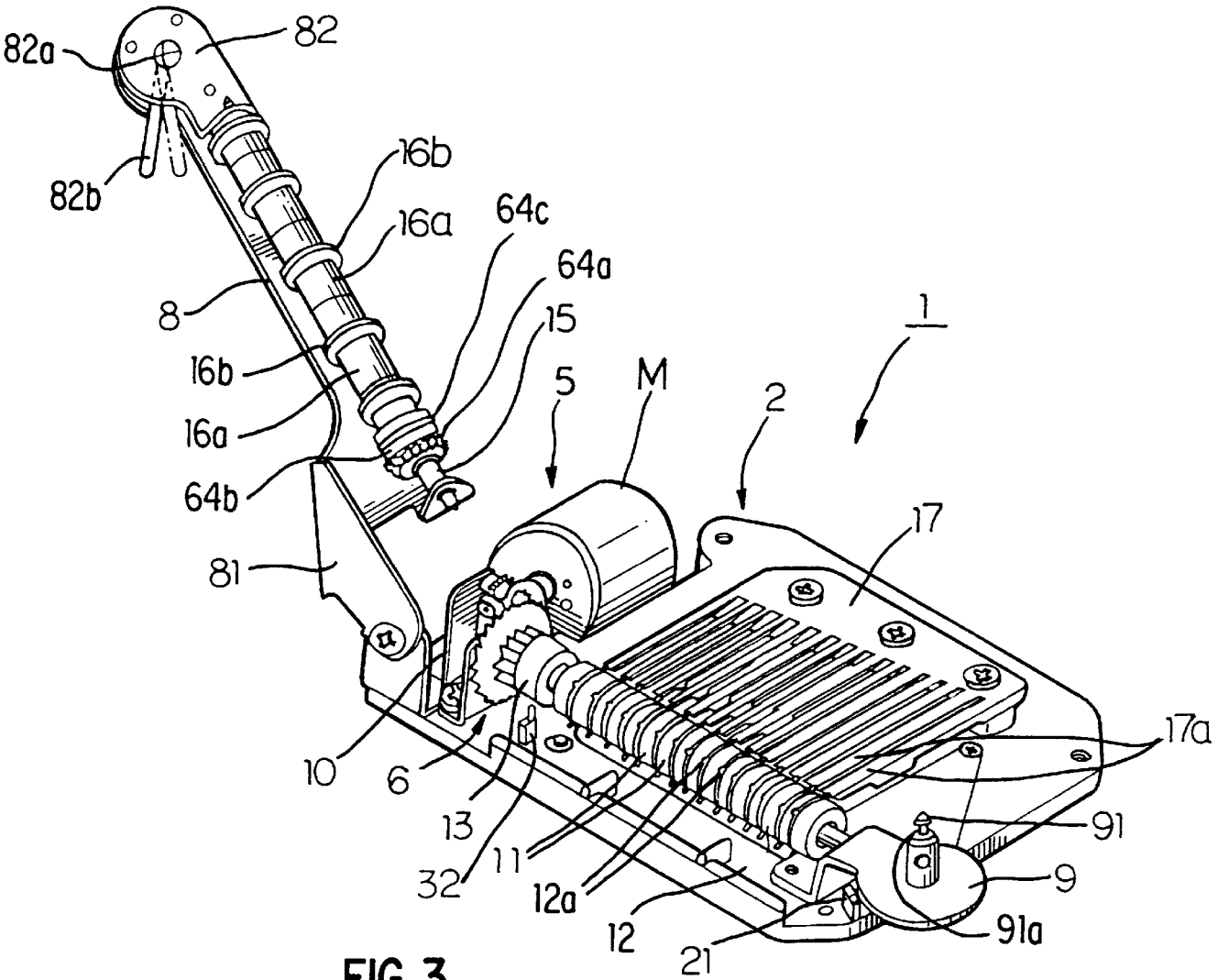
FIG. 3 is an external perspective view showing a state of an opened disc holding arm related to the disc music box of the invention.

In FIGS. 1–3, a disc music box 1 in this embodiment is a music box instrument which uses a circular plate-shaped disc 3 having play holes 4 as playing engaging parts formed corresponding to a music number, to play music.

This disc music box 1 comprises a music box body 2 which horizontally supports the disc 3 rotatably, a disc drive mechanism 5 which has a motor M for rotating the disc 3, a star wheel shaft 7 which is disposed below and to oppose the bottom face of the supported disc 3 and to support star wheels 12 rotatably, and a music box sounding member 17 which is disposed to oppose the star wheel shaft 7. The disc 3 is also formed a record section 31 which includes control information for an instrument in association with the music box's play to be described afterward, and a reading unit 32 for obtaining the control information is disposed on the music box body 2.

The disc music box 1 includes the music box sounding member 17 having music box petals 17*a* which are formed in a prescribed number in the shape of comb teeth corresponding to the number of musical intervals and disposed horizontally on the music box body 2 as a base stand, the star wheel shaft 7 which rotatably supports the star wheels 12 disposed to oppose these music box petals 17*a*, a disc holder which is disposed to oppose the star wheel shaft 7 to horizontally support the disc rotatably, and the disc drive mechanism 5 which has the motor M for rotating the disc 3 in a predetermined direction.

The music box sounding member 17 is made of a metal material to have long strips and disposed on the music box body 2 horizontally. Specifically, a base end at one end of the music box sounding member 17 is fixed to a base disposed on the music box body 2, and the music box petals 17*a* formed in the shape of comb teeth are at the other end of the music box sounding member 17. And, the music box petals 17*a* are formed in a predetermined number corresponding to the number of musical intervals to be sounded. The respective petals 17*a* are formed to have predetermined thicknesses and lengths corresponding to the musical intervals, and when the tips of the music box petals 17*a* are plucked, music box sounds with predetermined musical scales/musical intervals are produced.

And, the plurality of star wheels 12 are rotatably supported by the shaft to oppose these comb teeth (the music box petals 17*a*). Specifically, the star wheels 12 are fitted to the star wheel shaft 7 with play, and picks 12*a*, 12*b*, 12*c*, 12*d* are protruded at equal intervals on the outer peripheries of the star wheels 12. When a disc 3 selected as desired is fitted to the music box body 2 and a motor switch (not shown) is turned on, the disc 3 is rotated by the disc drive mechanism 5, the music box petals 17*a* corresponding to the musical scales of a music number are plucked by the picks 12*a*, 12*b*, 12*c*, 12*d* of the star wheels 12 to play the music box. Specifically, the respective play holes 4 of the disc 3 are engaged with the picks 12*a*, 12*b*, 12*c*, 12*d* of the star wheels 12 which correspond to the play holes 4 to force the star wheels 12 rotate, and the music box petals 17*a* are plucked by the subsequent picks 12*a*, 12*b*, 12*c*, 12*d* of the rotating star wheels 12 to produce music box sounds.

Figure 4:
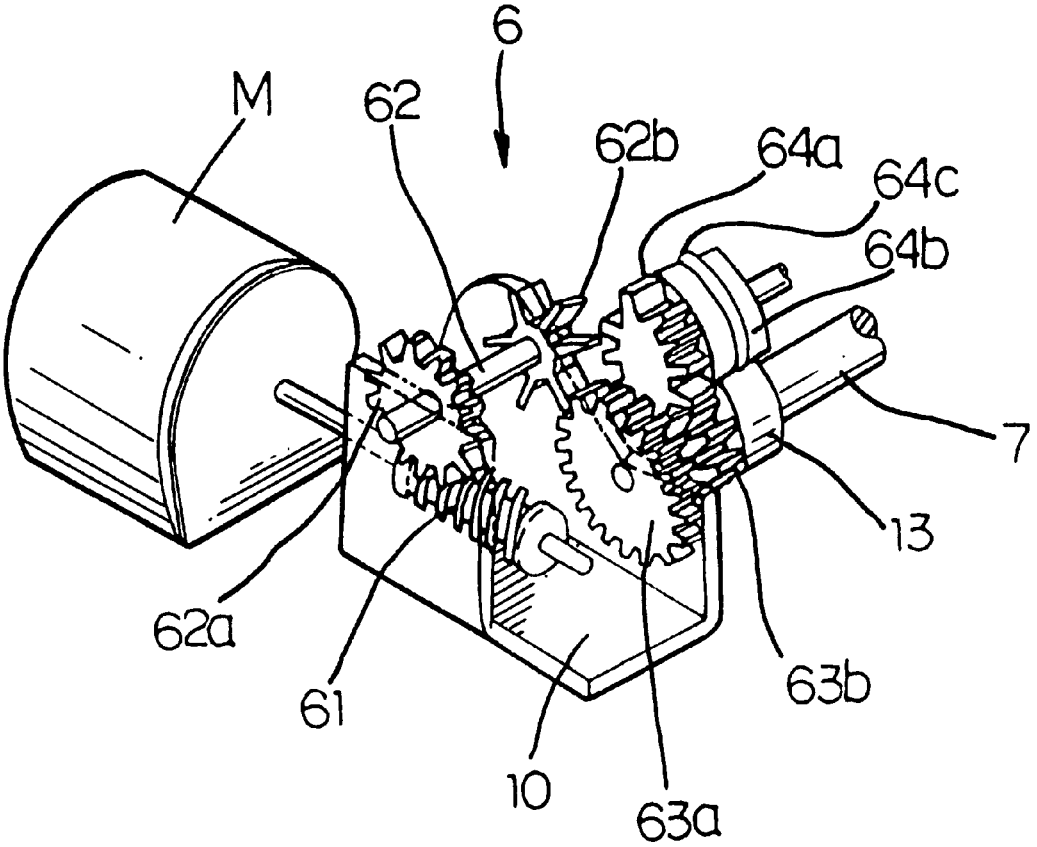
FIG. 4 is a perspective view showing a gear train of the disc music box of the invention.

The music box body 2 is provided with the motor M and a gear train 6 which decelerates and transmits the rotating drive force of the motor M to the star wheel shaft 7 and a disc pushing rotor 64*b* to be described afterward as shown in FIG. 4. The motor M is a DC motor and connected to a motor drive circuit (not shown), and a drive current for forward and reverse rotations is supplied from the motor drive circuit to effect the forward and reverse rotation of the motor M. And, the motor M is designed to start a predetermined operation when the monitor switch is turned on or the disc 3 is fitted.

The gear train 6 comprises a first gear 62*a*, a second gear 62*b*, and a third gear 63*a* which are sequentially connected to a worm gear 61 of the motor M, a fourth gear 63*b* which rotates together with the third gear 63*a* is connected to a gear 64*a* which is fixed to a holding roller shaft 15. Therefore, the motor drive force is decelerated to a predetermined level and transferred to drive the disc 3 at a predetermined rotating speed. Specifically, the worm gear 61 made of plastics is fixed to the output shaft of the motor M and engaged with the first gear 62*a*. The first gear 62*a* is orthogonal to the motor output shaft and fixed to one end of a plastic shaft 62 which is supported in parallel to the star wheel shaft 7. The second gear 62*b* is fixed to the other end of the shaft 62 and rotated together with the first gear 62*a*. And, the second gear 62*b* is engaged with the third gear 63*a* which is fixed to the star wheel shaft 7 at its end on the side of the motor. And, a predetermined deceleration ratio is determined among these gears 62*a*, 62*b* and 63*a*.

Besides, the fourth gear 63*b* is coaxially fixed to the third gear 63*a* to rotate together. And, the fourth gear 63*b* is engaged with the gear 64*a*, and their gear ratio is determined to be 1:1. Specifically, the gear 64*a* is fixed to the holding roller shaft 15 at its end on the side of the motor, and the holding roller shaft 15 is supported in the longitudinal direction of a disc holding arm 8. And, when the disc holding arm 8 is in a closed position, the fourth gear 63*b* is engaged with the gear 64*a* for rotating the disc 3. In the gear train 6, when the motor M revolves, its rotating drive force is transmitted from the worm gear 61 to and in the order of the first gear 62*a*, the second gear 62*b* which rotates with the first gear 62*a*, the third gear 63*a* which engages with the second gear 62*b*, and to the fourth gear 63*b* which rotates with the third gear 63*a*, successively. While being transmitted, the drive force is decelerated to a predetermined speed by a gear ratio determined among these gears. And, as the fourth gear 63*b* rotates, the star wheel shaft 7 having the fourth gear 63*b* fixed at its end is rotated, and at the same time, the gear 64*a* for rotating the disc, which is engaged with the fourth gear 63*b*, is rotated.

Figure 5:
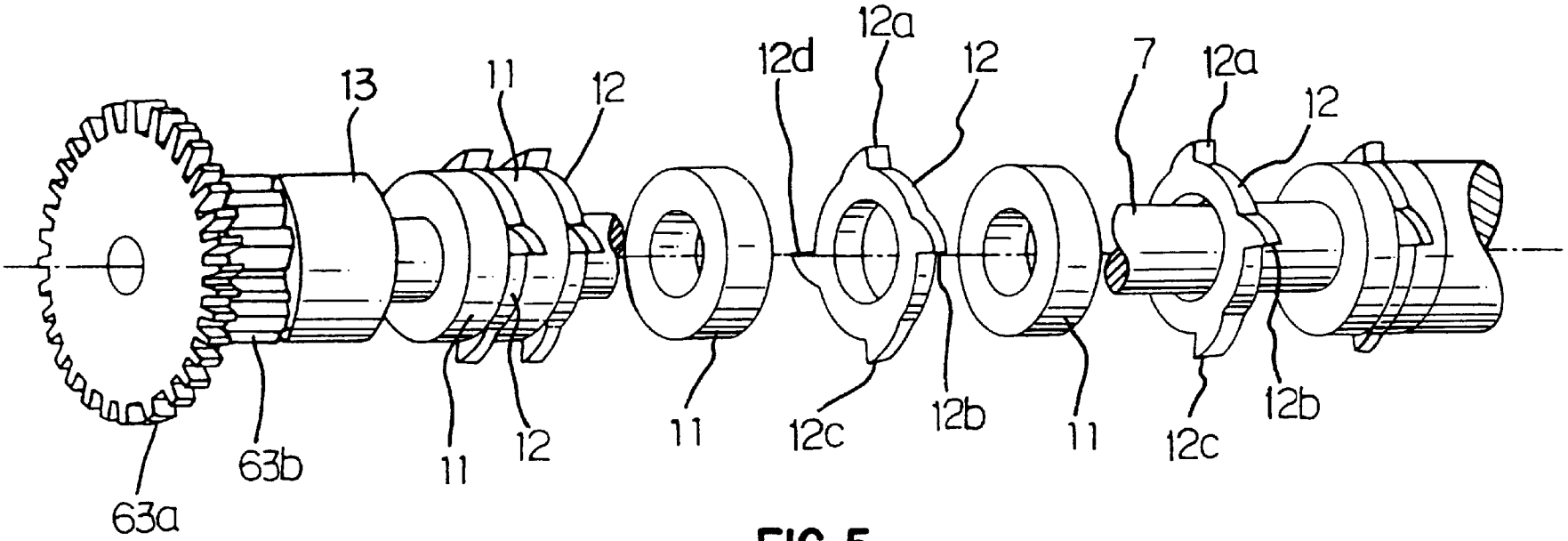
FIG. 5 is an exploded perspective view of star wheels and a star wheel shaft with partial omission according to the invention.
Figure 6A:
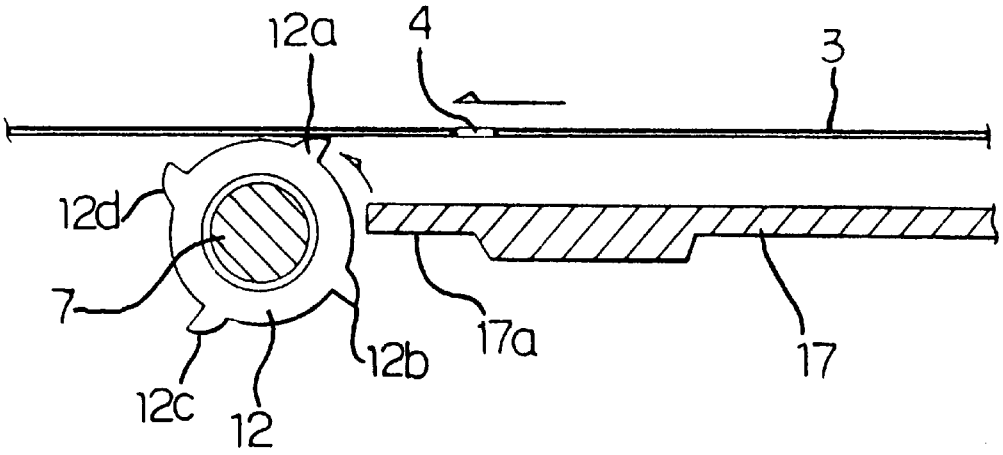
FIG. 6 is to illustrate how the disc music box of the invention operates to produce a sound, wherein (1) shows a state ready to produce a sound, (2) shows an initial state that a pick of the star wheel is engaged with a play hole of the disc, (3) shows a state that a music box petal is plucked by a pick of the star wheel to produce a sound, and (4) shows a state restored to be ready to produce a sound.
Figure 6B:
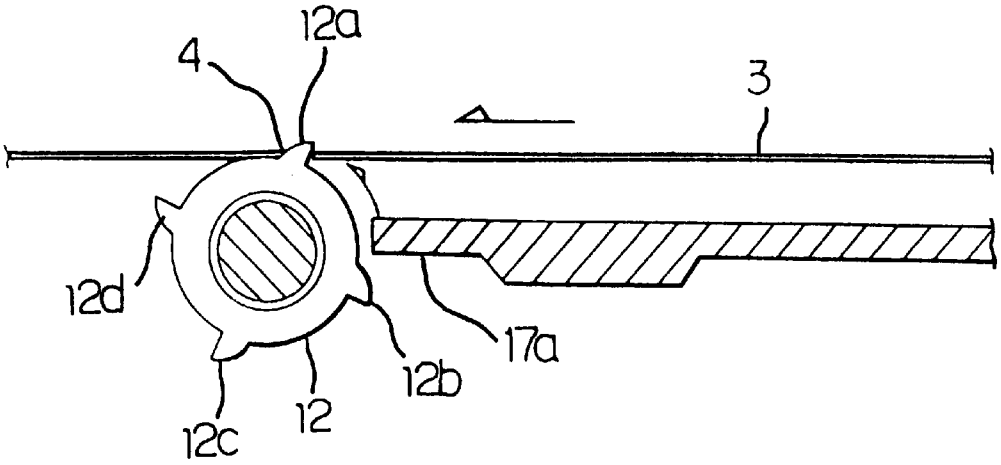
Figure 6C:
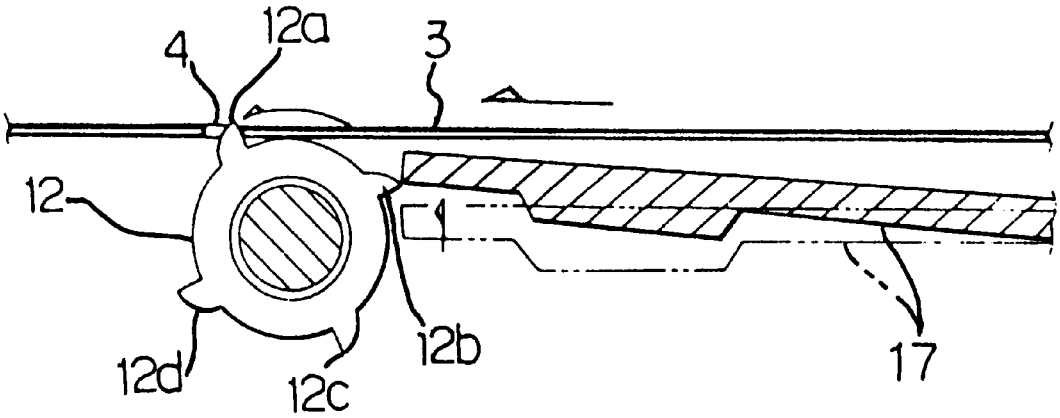
Figure 6D:
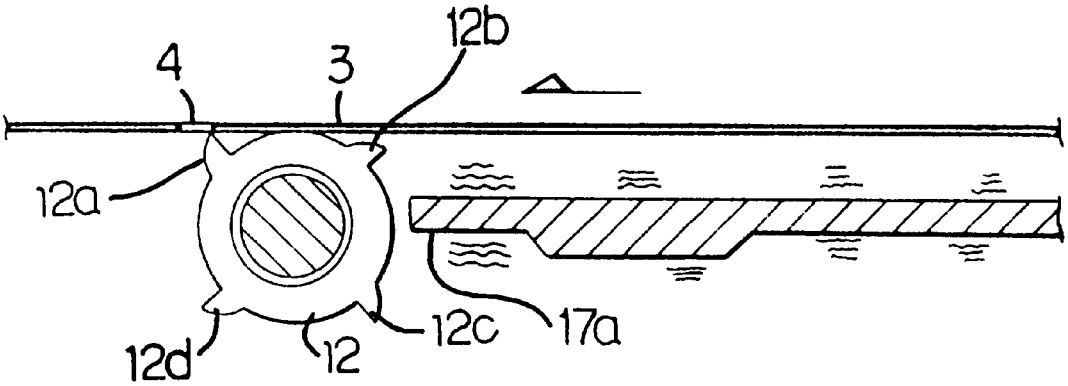

By rotating the star wheel shaft 7 in the forward direction, the respective star wheels 12, 12 are kept rotated in the forward direction to make normal play as will be described afterward, and their picks 12*a*, 12*b*, 12*c*, 12*d* are readily placed in the play holes 4 of the disc 3 which is rotated to an engaging position. And, since the gear 64*a* is rotated, the disc pushing rotor 64*b* which is integrally formed with the gear 64*a* is rotated together with the gear 64*a*. The star wheel shaft 7 is rotatably disposed between a disc fixture 9 which is fixed by screws onto the music box body 2 on the side opposite from the motor M and a substantially U-shaped upward supporting member 10 which is fixed by screws onto the music box body 2 on the side of the motor M. As shown in FIG. 5, star wheel partition members 11, 11 which are formed into a ring having a predetermined thickness are fixed at predetermined intervals to the star wheel shaft 7, and the star wheels 12, 12 are rotatably fitted between the star wheel partition members 11, 11. And, a disc holding roller 13 is fixed to the star wheel shaft 7 at a position next to the fourth gear 63*b*. The shaft 62 with the first gear 62*a* and the second gear 62*b* integrally formed is mounted between the walls of the U-shaped supporting member 10.

The disc holding arm 8 is formed into a long plate which is longer than at least the radius of the disc 3, its one end is pivotally mounted on the music box body 2, and its other end is formed to be engageable with the disc fixture 9 of the music box body 2. Specifically, a base 81 of the disc holding arm 8 is pivotally fitted to a supporting member 14 which is disposed on the music box body 2 on the side of the outer periphery of the disc 3, and an insertion hole 82*a* which receives and engages with a projection 91 of the disc fixture 9 to which the disc center is fitted is formed on a leading end 82. Besides, the projection 91 has its tip provided with a groove 91*a* along its entire circumference, and a stopper bar 82*b* which is pivotally energized to be engaged with the groove 91*a* is disposed in the neighborhood of the insertion hole 82*a*. Therefore, when the disc holding arm 8 is pivoted upward, the center hole of the disc 3 is fitted to the projection 91 of the disc fixture 9, and the disc holding arm 8 is pivoted downward to engage the insertion hole 82*a* with the projection 91; the pivotally energized stopper bar 82*b* is locked in engagement with the groove 91*a* to fit and fix the disc holding arm 8, namely the disc 3.

The disc holding arm 8 has the holding roller shaft 15 supported in the longitudinal direction of the disc holding arm 8. And, the gear 64*a* and the disc pushing rotor 64*b* integrally formed with the gear 64*a* are fixed to one end of the holding roller shaft 15. And, a plurality of plastic cylinders 16*a* are fitted to the holding roller shaft 15. A circular holding roller 16*b* is integrally formed with the cylinder 16*a*, and the holding roller 16*b* pushes the disc 3 toward the star wheels 12 and holds in the pushed state when the disc 3 is held by the disc holding arm 8.

Therefore, the disc music box 1 in this embodiment can use a relatively thin disc because a part of the disc 3 opposed to the star wheels 12, 12 is held by the disc holding arm 8 which is provided with the holding rollers 16*b*. And, since the outer periphery of the disc 3 is held between the disc holding roller 13 and the disc pushing rotor 64*b*, the disc 3 is rotated stably with reliability as the disc holding roller 13 and the disc pushing rotor 64*b* are rotated. Besides, a rubber ring 64*c* is fitted to the periphery of the disc pushing rotor 64*b* to prevent slips when the disc 3 is rotated.

The respective star wheels 12, 12 are made of a metal material and formed into the shape of a ring, and fitted to the star wheel shaft 7 with play. In addition, four picks 12*a*, 12*b*, 12*c*, 12*d* are protruded at predetermined intervals of 90 degrees from the outer periphery of the ring. These picks 12*a*, 12*b*, 12*c*, 12*d* are formed to have a sloped surface curved in the forward rotating direction but to have a flat surface orthogonal to the rotating direction with respect to the reverse rotating direction.

Therefore, when the star wheel shaft 7 is rotated in the forward direction, the respective star wheels 12, 12 are also rotated in the same direction, and when any of the picks 12*a*, 12*b*, 12*c*, 12*d* comes in contact with the music box petal 17*a* of the music box sounding member 17, the star wheel shaft 7 is rotated without a load, and the star wheel wheels 12, 12 become ready to make sounds. And, the disc 3 rotates, and predetermined play holes are engaged with the corresponding picks of the star wheel 12 to produce predetermined music box sounds. In other words, the picks 12*a*, 12*b*, 12*c*, 12*d* positioned at the head of the forward rotating direction are engaged with the play holes 4 of the disc 3 and forced to rotate, so that the music box petals 17*a* are plucked.

Specifically, as shown in FIG. 6, the disc 3 is rotated in the forward direction (FIG. 6 (1)), the play hole 4 is engaged with, for example, the pick 12*a* among the picks 12*a*, 12*b*, 12*c*, 12*d* of the star wheel 12 (FIG. 6 (2)), the pick 12*a* is forced to move by the play hole 4, and the star wheel 12 is rotated. At the same time, the pick 12*b* next to the pick 12*a* of the star wheel 12 comes in contact with the music box petal 17*a* (FIG. 6 (3)) and further rotates to pluck the music box petal 17*a* (FIG. 6 (4)), thus the music box petal 17*a* produces a music box sound at the musical scale particular to the music box petal 17*a*. On the other hand, when the star wheel shaft 7 is rotated in the reverse direction, the picks 12*a*, 12*b*, 12*c*, 12*d* come in contact with the music box petal 17*a*, the star wheel 12 slips with respect to the star wheel shaft 7 to stop where it is. In this embodiment, the disc drive mechanism 5 for rotating the disc 3 and the shaft drive mechanism for rotating the star wheel shaft 7 are formed of the same drive system using the motor M and the gear train 6.

Figure 7:
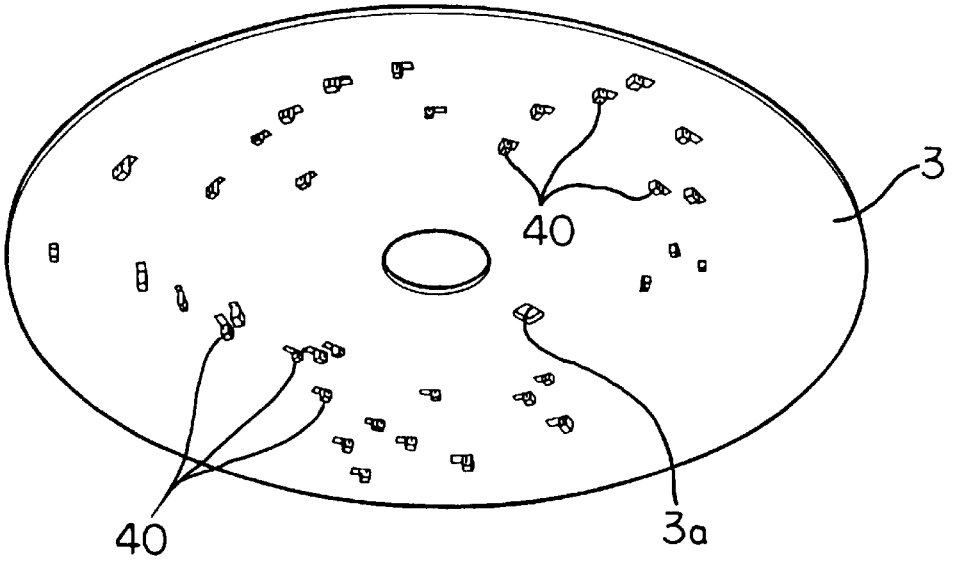
FIG. 7 is a perspective view of another disc viewed from below according to the invention.
Figure 8A:
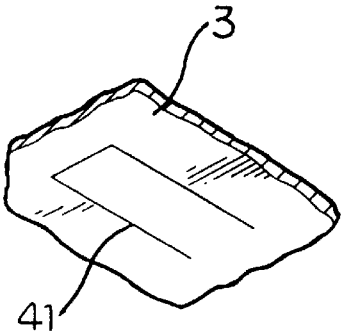
FIG. 8 is to show how a projection is formed on another disc of the invention, wherein (1) is a perspective view showing a state that a long squared U-shaped incision is made on the disc, (2) is a perspective view showing a state that the incision is pushed and erected, and (3) is a perspective view showing a state that the erected part is folded double as projection.
Figure 8B:
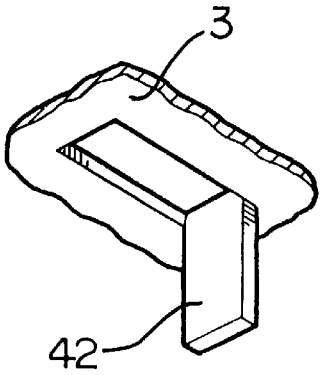
Figure 8C:
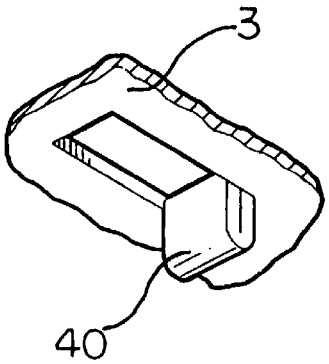
Figure 9A:
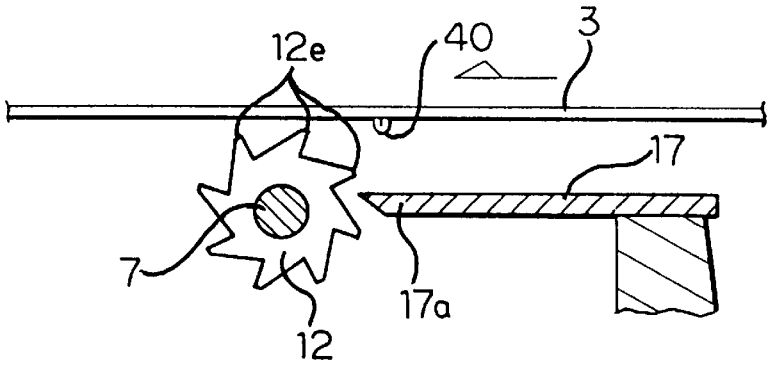
FIG. 9 is to illustrate how the disc music box of the invention operates to produce a sound, wherein (1) shows a state ready to produce a sound, (2) shows an initial state that a pick of the star wheel is engaged with a projection of the disc, (3) shows a state that a music box petal is plucked by a pick of the star wheel to produce a sound, and (4) shows a state restored to be ready to produce a sound.
Figure 9B:
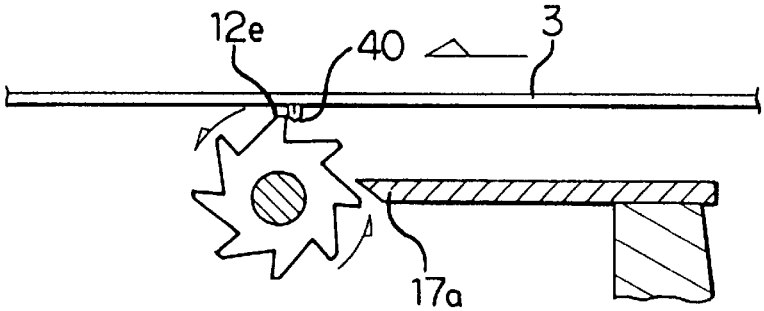
Figure 9C:
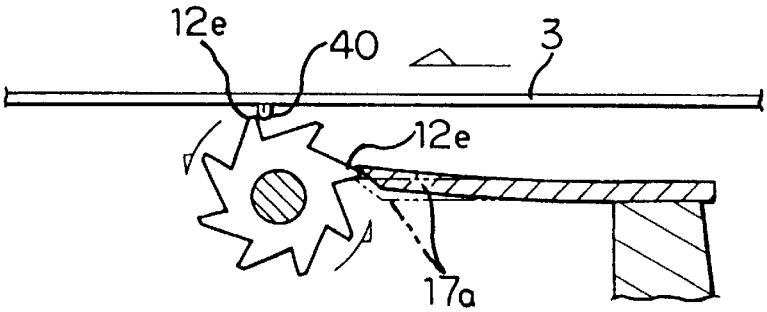
Figure 9D:
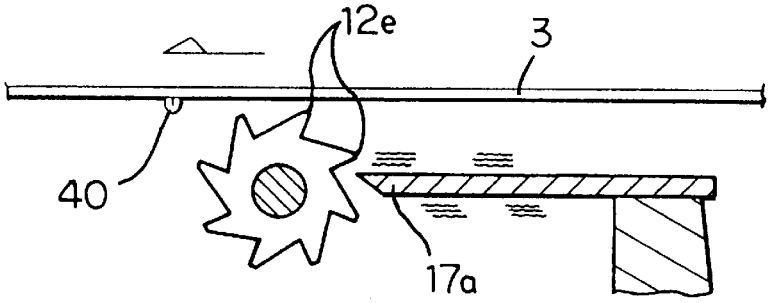

FIG. 7 shows another example of the playing engaging parts formed on the disc 3. The disc 3 is made of a metal and has projections 40 formed as the playing engaging parts by cutting in the disc 3 and erecting. Specifically, as shown in FIG. 8, a long square U-shaped incision 41 is formed (FIG. 8 (1)), the incision 41 is pushed and erected as an erected part 42 (FIG. 8 (2)), and the erected part 42 is folded at its middle to form the projection 40 (FIG. 8 (3)).

When the disc 3 has the projections 40, the respective star wheels 12, 12 are provided with eight picks 12*e*, 12*e* as shown in FIG. 9. And, FIG. 9 (1) shows that the disc 3 is rotated in the forward direction, and the projection 40 is engaged with the pick 12*e* of the star wheel 12 (FIG. 9 (2)), the pick 12*e* is forced to move by the projection 40, and the star wheel 12 is rotated. At the same time, another pick 12*e* next to the pick 12*e* of the star wheel 12 comes in contact with the music box petal 17*a* (FIG. 9 (3)) and further rotates to pluck the music box petal 17*a* (FIG. 9 (4)), and as a result, a music box sound at the musical scale particular to the music box petal 17*a* is produced.

Besides, the disc music box 1 in this embodiment is provided with a stop switch 21 which has a switch bar 21*b* for detecting one turn of the disc 3 and the attachment or not of the disc. Specifically, the stop switch 21 is disposed at a predetermined position in the neighborhood of the disc fixture 9 on the music box body 2 to correspond to a stopper hole 3*a* which is formed at a predetermined position on the inner periphery of the disc 3 as shown in FIG. 1 to FIG. 3. And, a distance between the lower face of the disc and the stop switch 21 is determined to be shorter than the overall length of the switch bar 21*b*, namely it is set to a distance that the switch bar 21*b* is tilted in contact with the lower face of the disc.

Figure 10:
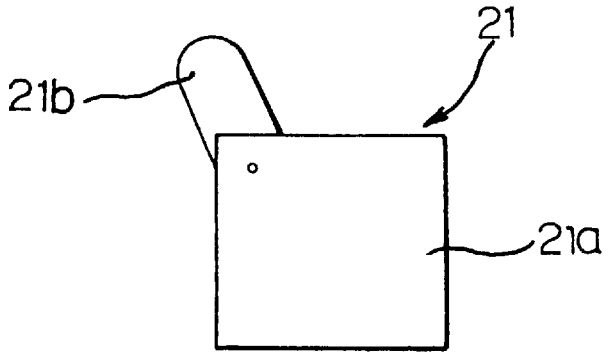
FIG. 10 is a front view showing a stop switch for detecting one turn of the disc of the invention.

This stop switch 21 has the switch bar 21*b* in the form of a pin on the top of a switch case 21*a* as shown in FIG. 10, and this switch bar 21*b* has its base end rotatably supported by the switch case 21*a* and also rotatably pushed by a spring or the like so that its end is directed upward. And, a contact terminal is interconnected to the base end of the switch bar 21*b,* and when the switch bar 21*b* is tilted sideways, the contact terminal is connected, and an on signal is output from the stop switch 21. On the other hand, when the switch bar 21*b* is erected upwards, the connection of the contact terminal is released to turn off the stop switch 21.

Figure 11A:
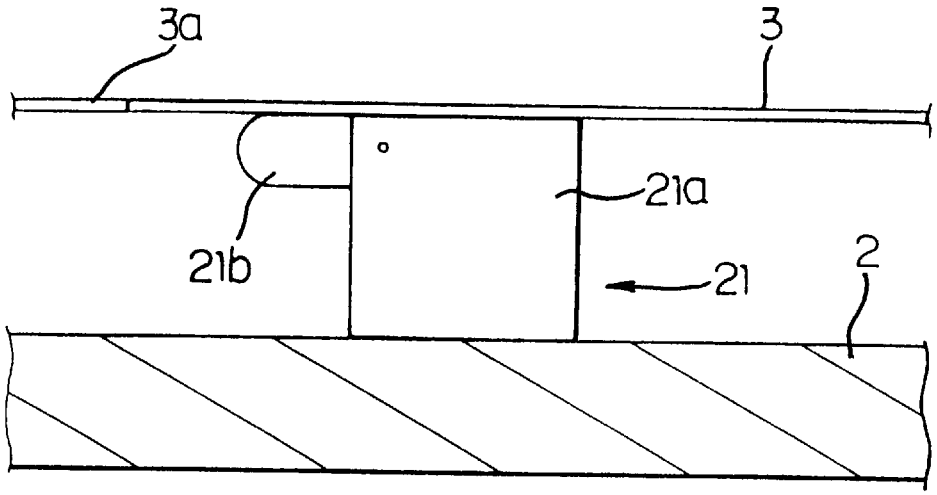
FIG. 11 is to illustrate how the stop switch of the invention operates, wherein (1) is a side view showing a state that a disc is turning, and (2) shows a state that one turn of the disc is detected.
Figure 11B:
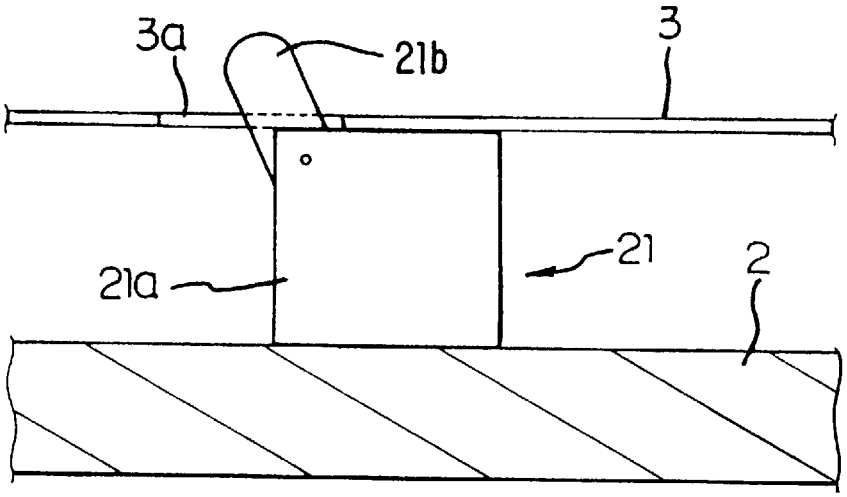

Therefore, when the disc 3 is fitted to the disc music box 1 or the music box is playing, the switch bar 21*b* of the stop switch 21 is in contact with the lower face of the disc 3 and inverted to output the on signal as shown in FIG. 11 (1). And, since the disc 3 has the stopper hole 3*a* corresponding to the stop switch 21 as shown in FIG. 11 (2), when the play of a single music number is completed as the disc 3 completes its one turn and the hole 3*a* comes to just above the switch bar 21*b,* the switch bar 21*b* enters the hole 3*a* to erect upwards, and an off signal is output from the stop switch 21 to the motor control circuit. Then, according to the off signal, the motor control circuit controls to make the overrun operation to continue the rotation of the disc 3 as determined, to rotate in the reverse direction to properly arrange the picks 12*a,* 12*b,* 12*c,* 12*d* of the star wheel 12, and stop the motor M of the disc drive mechanism 5.

Figure 12B:
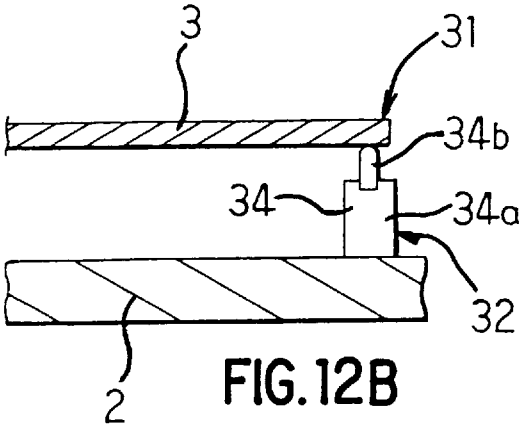
FIG. 12 is to illustrate another embodiment of the invention, wherein (1) is a top view of a disc, (2) is a schematic side view showing a reading section and its neighborhood, and (3) is a schematic side view showing a reading operation.
Figure 12C:
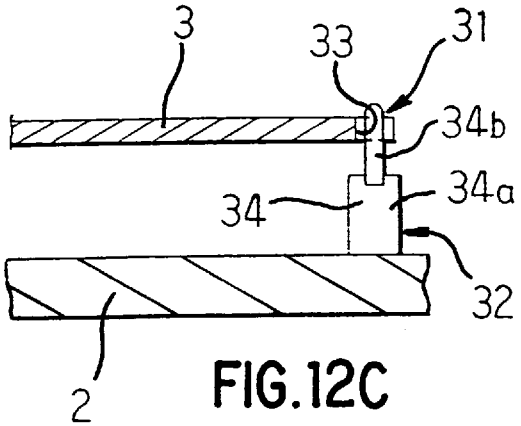
Figure 12A:
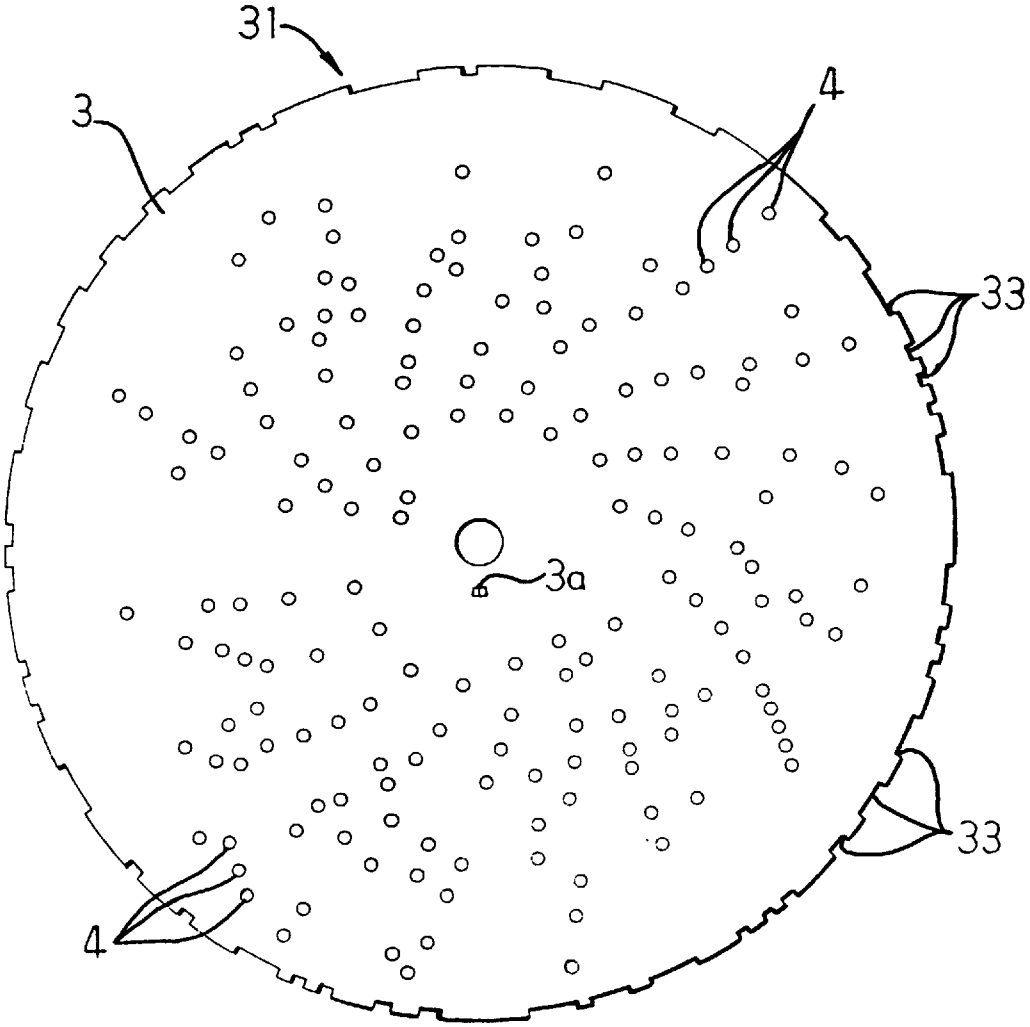

The disc music box of the invention will be described in detail with reference to FIG. 1 to FIG. 3 and a first embodiment shown in FIG. 12. The disc 3 in this embodiment has on its outmost periphery the record section 31 which is provided by forming notches as control information for the interconnected instrument, and an on/off type reading switch 34 is formed on the disc music box body 2 as a reading unit 32 for reading the control information. Specifically, as shown in FIG. 1 to FIG. 3 and FIG. 12 (1), the record section 31 is formed of notches 33 which are cut in a predetermined shape at a predetermined position on the outermost periphery of the disc 3. The notches 33 are determined to start from a point corresponding to a predetermined playing timing with the rotation of the disc 3 and given a predetermined arc length. And, where the notches 33 are formed is basically determined to a position synchronized with the play holes 4 in a radial direction.

The form of recording the control information may be determined to have different means depending on a length of each notch 33 in a circumferential direction, namely an arc length. For example, to change the method of controlling an instrument according to such a length, it is possible to make pulse control of a given instrument when the length is short, and to make DC control when the length is long. Besides, more multistage meaning may be provided depending on the length. And, this control information can be determined as required to synchronize with all play sounds of the music box or rhythm sounds only.

Therefore, the control information for the interconnected instrument only is recorded on a point avoiding the play holes of the disc 3 to directly control the instrument, so that detailed and flexible control can be improved. Since the record section 31 is provided on the outermost periphery of the disc where a length in the peripheral direction is long, the control information can be recorded in higher density.

As shown in FIG. 12 (2), the reading unit 32 is a mechanical switch 34 having a switch bar 34*b* on the top of a housing 34*a* so as to operate to stand or fall in the same manner as the stop switch 21. When the switch bar 34*b* of the reading switch 34 stands, an on operation signal is output. Specifically, the switch 34 is disposed at a predetermined point of the music box body 2 so as to correspond to the outermost periphery of the fitted disc 3 and a distance between the lower face of the disc and the switch 34 is shorter as determined than the overall length of the switch bar 34*b,* namely it is set to a distance so that the switch bar 34*b* is contacted to the lower face of the disc and tilted by it. Besides, its output terminal is directly connected to a drive circuit for an interconnected instrument (not shown) or connected to an integrated control circuit or the like for integrally controlling respective instruments.

Therefore, when the music box is played by rotating the disc and one of the notches 33 of the disc record section 31 comes to just above the reading switch 34, the tip of the switch bar 34*b* enters the notch 33, the on operation signal is output from the switch 34 as the reading unit 32, and subsequent respective instruments are driven.

Description will be made of the operation control of the disc music box 1 using the disc 3 which has control information recorded for such an interconnected instrument. It is assumed that the disc 3 is fitted to the disc music box 1 in advance by the user, and the star wheels 12 are properly arranged.

First, the user turns on the monitor switch or it becomes a preset time, and the music box starts a predetermined play and the instrument interconnected with the play starts to operate. Specifically, the motor control circuit of the disc music box 1 controls to drive the motor M as determined, and the motor drives the disc 3 to rotate from the play start point in the forward direction. And, the play holes 4 formed at predetermined positions on the disc 3 catch the picks 12*a,* 12*b,* 12*c,* 12*d* of the corresponding star wheels 12 to force the star wheels 12 rotate, the music box petals 17*a* are plucked by subsequent picks 12*a,* 12*b,* 12*c,* 12*d* of the rotating star wheels 12 to produce predetermined music box sounds.

At the same time, as shown in FIG. 12 (3), when the notch 33 formed at a predetermined point of the record section 31 of the disc 3 comes to just above the reading switch 34 of the reading unit 32, the tip of the inverted switch bar 34*b* enters the notch 33 to erect upwards, the on signal is output from the switch 34, and the subsequent instrument is operated through the drive and control circuits. In other words, the subsequent interconnected instrument is controlled to operate as predetermined in association with the music box playing. After the disc 3 is driven to make one or a plurality of turns, the music box stops playing. Specifically, the motor is driven under control of the motor control circuit to properly arrange the star wheels 12, and the disc 3 is stopped in the initial state for rotation from where the disc 3 starts to play.

In this embodiment, the mechanical switch 34 is used as the reading unit 32, but an optical sensor may be used. Specifically, when the control signals synchronized with musical notes are obtained and the number of musical notes are many, the mechanical switch 34 may not follow to read, while the optical sensor can follow to read the control information with reliability. And, since the control information is obtained from the disc by means of a non-contact optical sensor, the optical sensor and the disc can be prevented from being abraded, and endurance and reliability can be improved.

The position where the reading unit 32 for reading the control information for the interconnected instruments can be changed flexibly depending on where the components of the disc music box are mounted. Specifically, when the start point to rotate the disc for playing is assumed as reference, a position which is deviated by a half turn or a quarter turn as determined in the circumferential direction from the reference position may be recorded as a recording initiation position of the control information, so that the position of the reading unit 32 can be changed as required.

Besides, the combination of the record section 31 and the reading unit 32 can be determined appropriately so that the instrument to be controlled and the disc can be produced readily. For example, when a large number of on operation signals are wanted for a given instrument during the disc music box playing, the on control information is recorded as a remained portion without a notch in the record section 31 of the disc, and it can be read. And, the reading unit 32 for reading the control information may be configured by disposing a reverse circuit to reverse the switch detection output, thereby using a conventional one; setting the switch operation so as to make the on output when the switch bar 34*b* is inverted. As a result, the portion required for forming notches on the disc can be reduced, and the disc can be produced advantageously in view of its strength.

Furthermore, an instrument can be controlled regardless of the sounding timing of the music box's playing. For example, the instrument can be moved as required for preparation while the play is stopped. Thus, control can be made flexibly in accordance with the instrument. And, the same record section 31 may be changed according to the rotation cycle. Specifically, when the music box's playing consists of three parts of a prelude theme, a main theme and an ending theme, the control information from the same track can be controlled to be switched and used for another instrument for each theme.

In addition, in this embodiment, information is read from the notches of the record section from below and above the disc, but it may be read from the circumferential direction of the disc. And, the notch depth from the outermost periphery of the disc in the radial direction may be made in a multistage form, and it may be read by a multistage switch to obtain various types of information. These modifications may also be applied to the respective embodiments to be described afterwards.

As described above, in the disc music box of this embodiment, the disc is provided with a record section containing information for controlling an interconnected instrument to directly control the interconnected instrument as the music box plays, and the instrument can be controlled directly and in parallel in association with the music box's play, thus the circuit structure can be made simple. Since each disc can record the control information different for an instrument and the disc can be exchanged readily, the operation of the instrument can be changed flexibly in addition to the change of the music number according to a situation. For example, by providing discs having the same music number but different control information in advance, the interconnected instrument can be operated in a different way quickly and readily with the same music number played by simply changing the discs.

The disc music box 1 of the invention will be described with reference to another embodiment shown in FIG. 13. The disc 3 in this embodiment has a plurality of record sections 31 which are formed between tracks including play holes, and a plurality of reading units 32 disposed on the disc music box body 2 to correspond to the record sections 31 in the radial direction of the disc 3. Specifically, as shown in FIG. 13 (1), the record sections 31 are configured by forming arc slit notches 35 between the circumferential tracks of the disc 3 having the play holes 4 to record control information by the notches 35.

The record sections 31 are configured to record the control information at predetermined points between the circumferential tracks having the play holes 4 on the disc 3 by the notches 35 which are cut in the form of a predetermined slit. The points where these notches 35 of the record sections 31 are formed and the arc length can be determined as required in the same manner as in the above-described embodiment. Therefore, the plurality of record sections 31 can be disposed while restricting the degradation of the disc strength to minimum. And, the control method of an instrument by the control information of the record sections 31 can control dedicated instruments for each record section 31, and can control a single instrument by a plurality of control information, and such control can be combined or determined as desired. The same can also be applied to the embodiments to be described afterwards. Therefore, since control information corresponding to an instrument to be controlled can be recorded, the interconnected instruments can be controlled highly and efficiently.

Figure 13B:
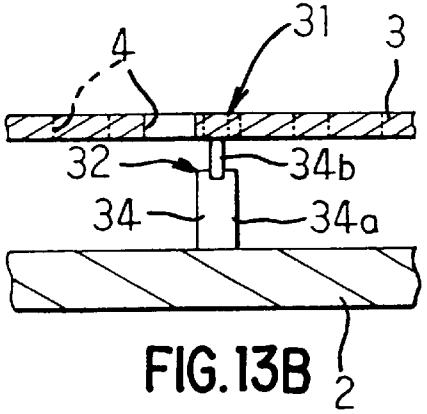
FIG. 13 is to illustrate another embodiment of the invention, wherein (1) is a top view of a disc, (2) is a schematic side view showing a reading section and its neighborhood, and (3) is a schematic side view showing a reading operation.
Figure 13C:
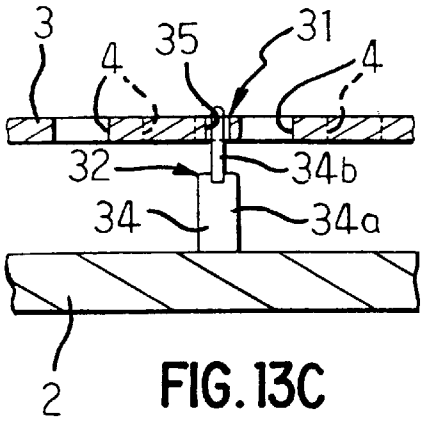
Figure 13A:
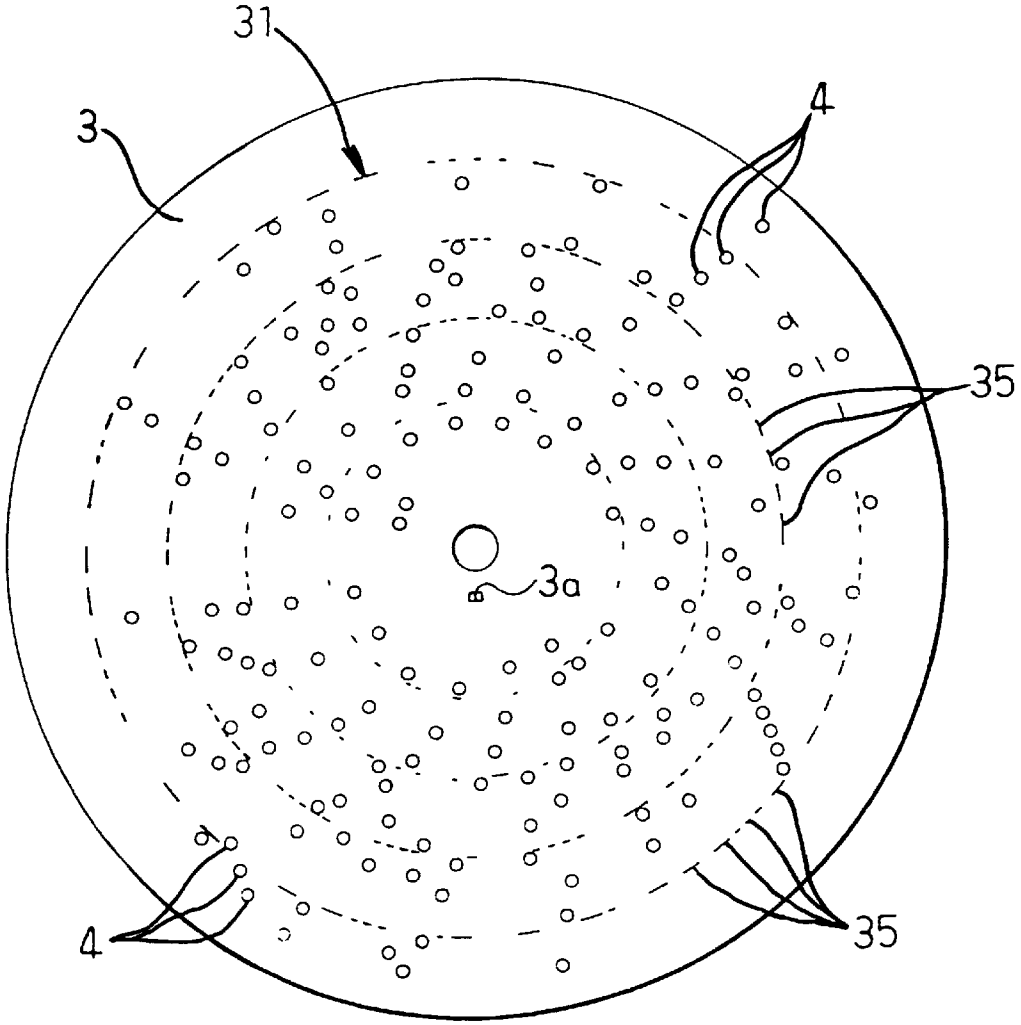

As shown in FIG. 13 (2), the reading unit 32 is formed of a mechanical reading switch 34 in the same way as in the previous embodiment. Therefore, as shown in FIG. 13 (3), information in the record section can be read as determined as the music box plays. And, in the same way as in the previous embodiment, a simple switch can be used as the reading unit 32, and a cost can be lowered.

Figure 14B:
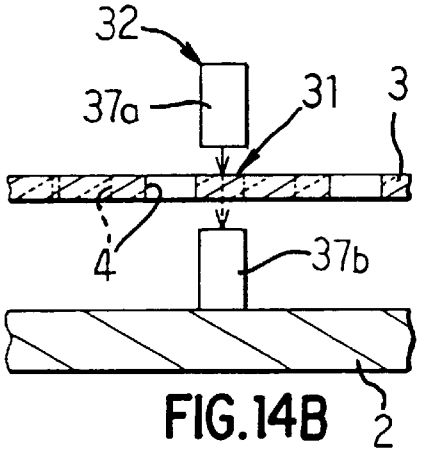
FIG. 14 to describe another embodiment of the invention, wherein (1) is a top view of a disc, (2) is a schematic side view showing a reading section and its neighborhood, and (3) is a schematic side view showing a reading operation.
Figure 14C:
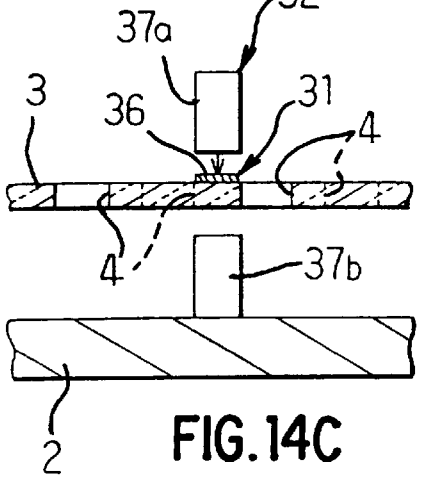
Figure 14A:
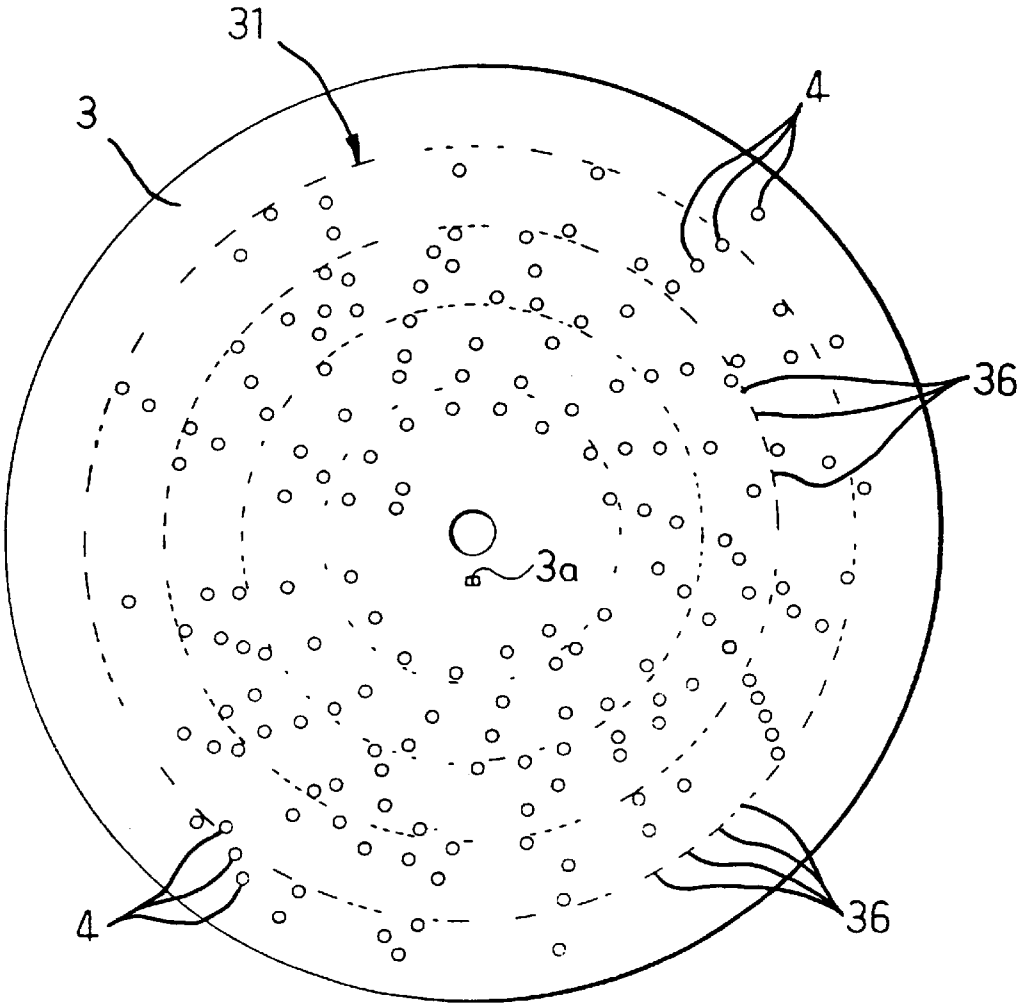

The disc music box 1 of the invention will be described with reference to another embodiment shown in FIG. 14. The disc 3 of this embodiment is formed of a material having permeability, record sections 31 which contain recorded control information formed of block members 36 for blocking light transmission are disposed on the disc 3, and a reading unit 32 consisting of a light emitting diode 37*a* and a light receiving sensor 37*b* is disposed on the disc music box body 2. Specifically, as shown in FIG. 14 (1) to (3), the disc 3 of this embodiment is formed of a material which allows the passage of a predetermined quantity of light and has play holes 4 for a music box in the same way as prior art. And, the record sections 31 are configured to record the control information by disposing the block members 36 for blocking light transmission at predetermined points in the circumferential direction between the circumferential tracks having the play holes 4 on the transmission disc.

Specifically, the record sections 31 of this embodiment are different from the previous embodiment and configured by disposing the block members 36 for blocking light transmission at the predetermined points without cutting off the predetermined points of the disc. Therefore, the mechanical strength of the disc 3 can be prevented from being degraded, and the music box can be played stably and reliably.

Besides, as shown in FIG. 14 (2), the reading unit 32 consists of the light emitting diode 37*a* and the light receiving sensor 37*b* which are disposed with the disc 3 therebetween at a predetermined position in the radial direction corresponding to the record sections of the disc 3. The light emitting diode 37*a* is a general light emitting diode, and a predetermined drive current is supplied at least when the music box is playing to emit a predetermined quantity of light from the light emitting diode. And, the light emitting diode 37*a* may be eliminated by configuring to use natural light, namely to introduce natural light from outside the disc music box.

The light receiving sensor 37*b* is a general light sensor, and in the same manner as the mechanical switch, its output terminal is directly connected to a drive circuit for an interconnected instrument (not shown) or connected to an integrated control circuit or the like for integrally controlling respective instruments. Besides, the light receiving sensor 37*b* of this embodiment is determined to output a detection signal while it is not receiving light, but in the same way as the above-described mechanical switch, can be set as desired to output the detection signal while light is being received or not being received, and a reverse circuit may be connected to the output terminal.

Therefore, the light emitted from the light emitting diode 37*a* of the reading unit 32 enters the light receiving sensor 37*b* through the transmission disc, a detection signal is not output from the light receiving sensor 37*b* of the reading unit 32, and the subsequent instrument is not driven. And, the disc is rotated as the music box plays, and as shown in FIG. 14 (3), when the block member 36 of the record section 31 reaches between the light emitting diode 37*a* of the reading unit 32 and the light receiving sensor 37*b*, the light emission from the light emitting diode 37*a* is blocked, a detection signal is output from the light receiving sensor 37*b* of the reading unit 32, and according to the detection signal, the subsequent instrument is driven under control.

As described above, instead of previously recording the control information in a fixed manner, it may be changed by the user as desired. Specifically, the member for blocking the light transmission can be paint which can be removable or a member such as a removable seal as far as it can block the light transmission to a predetermined quantity, and any member which can be changed readily by the user may be used. Therefore, the instrument can be tested for its operation, the operation of a specific instrument can be restricted by the user as required, and the operation can be changed, enabling to conform with various situations of use. And, the recording form of control information can be coded like a bar code so that various types of information can be recorded.

Besides, the recording form of control information can be changed from the binary form of on and off to a multiple code which is successively variable, so that a range of application can be expanded. Specifically, the control information described portion may be configured by mixing a translucent material or changing the slit width to a shape as desired, so that the light quantity passing through the slit is successively changed as desired as the disc rotates, and a light sensor which outputs a voltage or a current signal corresponding to the variable quantity of received light can be used. Thus, in this case, a current or a voltage signal for controlling which changes in an analog fashion and successively can be obtained to directly control various instruments, while a digital on/off control signal is obtained by the above described structure.

As described above, the disc music box of this embodiment has the same effects as the above-described embodiment, and since the information for controlling the instrument in an associated manner is not indicated as the cut holes but indicated by a member which blocks the transmission of light, the mechanical strength of the disc can be prevented from being degraded, and the music box can be operated to play music stably and with reliability. And, when control signals synchronized with musical notes are obtained and the number of musical notes is many, it may be difficult to follow to read by a mechanical switch, but this embodiment can follow and read the control information with reliability. Besides, since the non-contact light sensor is used to obtain the control information from the disc, the light sensor and the disc can be prevented from being abraded, and durability and reliability can be improved.

When a specific instrument for interconnected operation has a plurality of operation modes, a plurality of tracks are used as regions for recording the control information for the relevant instrument to deal with easily. Specifically, a plurality of on/off information can be combined to obtain different types of operation signals. For example, when there are two tracks, four types of control signals can be obtained including operation stop. And, when it is necessary to obtain a more complex control signal, the control information can be coded like a bar code and recorded. But, a circuit for decoding is required in addition.

Furthermore, the above-described hole for detecting one turn of the disc may be formed of the mark of this embodiment, the disc strength is not degraded and the regions for the holes are not required, so that the disc itself can be made compact. And, a mark pattern can be configured to detect the rotation position when the disk is fitted, so that the arranging operation of the wheel picks can be optimized. Specifically, the operation can be controlled so that the rotation position of the fitted disc is detected and the wheel picks can be appropriately arranged from that rotation position in the shortest time.

Besides, a plurality of control information record tracks and reading units 32 are disposed in advance, and the control information is changed to different one as desired or on a random basis as the disc makes one turn, so that the associated instrument can be operated in various ways. And, in addition to the above-described recording of control information on the plurality of concentrically formed tracks, a single or appropriate plurality of tracks can be configured from the inner to outer peripheries to record in a spiral form. For example, a tricky device can be moved successively to recollect a long story by only a single music number.

The disc music box of the invention will be described with reference to another embodiment shown in FIG. 15. The disc music box 1 of this embodiment is configured in that at least one side of the disc 3 is formed of a reflective material, control information for an instrument is recorded by a block member 39 which blocks the reflection on the disc surface, and the reading unit 32 having the light emitting diode 37*a* and the light receiving sensor 37*b* opposed thereto is fixed to the disc music box body 2. Specifically, the record section 31 is formed in the same way as in the third embodiment in that predetermined portions of the disc 3 are not cut out, and the block member 39 having a predetermined shape to prevent the reflection is disposed on the predetermined portions. Therefore, the mechanical strength of the disc can be prevented from being degraded, and the music box can be operated to play music stably and with reliability.

Figure 15B:
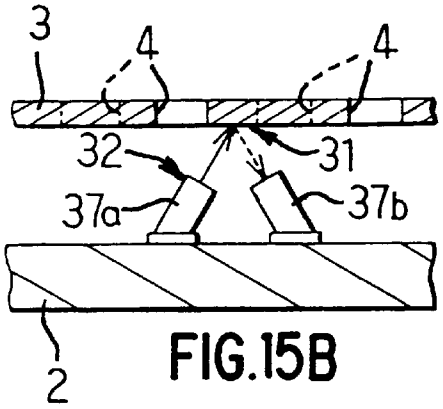
FIG. 15 is to illustrate another embodiment of the invention, wherein (1) is a bottom view of a disc, (2) is a schematic side view showing a reading section and its neighborhood, and (3) is a schematic side view showing a reading operation.
Figure 15C:
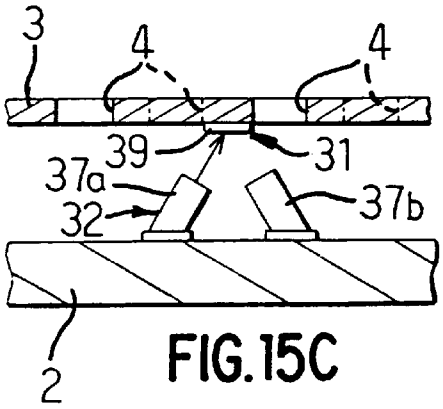
Figure 15A:
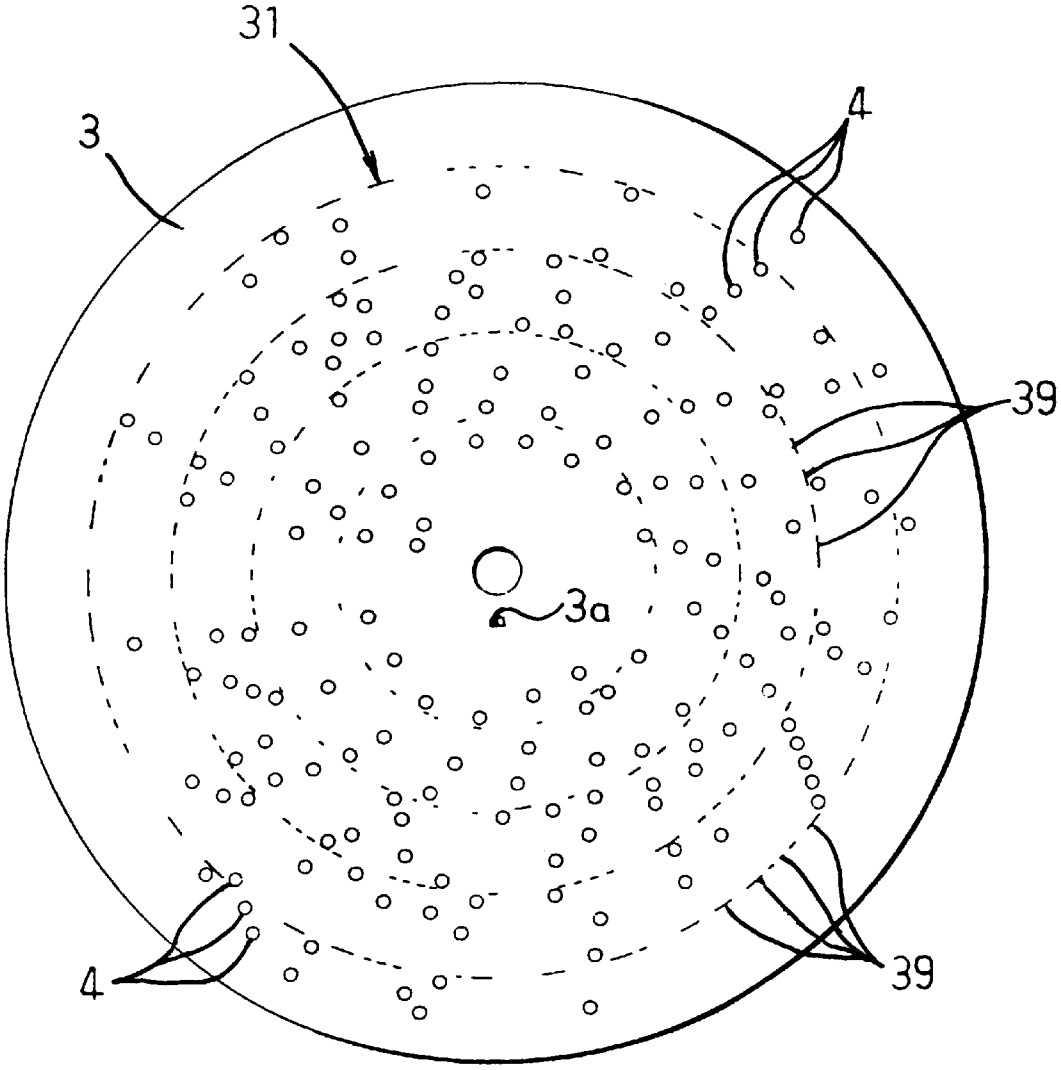

Furthermore, as shown in FIG. 15 (2), the reading unit 32 of this embodiment comprises a pair of the light emitting diode 37*a* and the light receiving sensor 37*b* in the same way as in the above embodiment, and it is disposed at a predetermined position in a radial direction corresponding to the record section 31 of the disc so as to face the record section 31 of the disc. This light emitting diode 37*a* is a general light emitting diode, and a predetermined drive current is supplied at least when the music box is playing to emit a predetermined quantity of light from the light emitting diode. And, the light receiving sensor 37*b* is a general light sensor, and in the same manner as the mechanical switch, its output terminal is directly connected to a drive circuit for an interconnected instrument (not shown) or connected to an integrated control circuit or the like for integrally controlling respective instruments. Besides, the light receiving sensor 37*b* of this embodiment is determined to output a detection signal while it is not receiving light, but in the same way as the above-described mechanical switch, can be set to output the detection signal while light is being received, and a reverse circuit may be connected to the output terminal.

Therefore, the light emitted from the light emitting diode 37*a* of the reading unit 32 enters the light receiving sensor 37*b* by being reflected on the reflecting surface of the disc, a detection signal is not output from the light receiving sensor 37*b* of the reading unit 32, and the subsequent instrument is not driven.

As shown in FIG. 15 (3), the disc is rotated as the music box plays, and when the reflection block member of the record section 31 reaches a predetermined position, the light emission from the light emitting diode 37*a* of the reading unit 32 is blocked and not entered the light receiving sensor 37*b*, a detection signal is output from the light receiving sensor 37*b* of the reading unit 32, and according to the detection signal, the subsequent instrument is driven under control. When the reflection part is used as the recorded control information, the entire disc surface is not required to be the reflection surface, the production can be facilitated, and the application range can be expanded. Specifically, a conventional disc can have, for example, a reflection seal adhered to additionally record the control information, or to change the control information by the user as required.

In this embodiment, the reflection or non-reflection part of the disc is used as a control information recording means, namely only one side of the disc is used to record information, but information may be recorded on both sides, so that a larger quantity of information can be recorded. And, the above-described method of recording the instrument controlling information by using the transmitted light corresponding to the rotation position of the disc and the method of this embodiment using the reflection light can be combined to be applied, so that much more kinds of control information can also be recorded. Specifically, based on the three recording forms using the transmitted, non-transmitted, and non-transmitted and reflected light, a more finely divided combination form of transmitting a half quantity of light and reflecting a half quality of light can be set.

As described above, the disc music box of the embodiment has the same effects as the previous embodiment, and additionally can record a larger quantity of control information, so that much more interconnected instruments can be controlled directly, in parallel, flexibly and highly. Besides, in addition to the above-described embodiments, the present invention can also have a structure that a single or multiple of the engaging parts for playing in this type of disc music box are specified, and the specified engaging part(s) is used as the record medium for control information to control another instrument which operates in association with the play of the music box. For example, among the plurality of projections 40, 40 as the engaging parts for playing as shown in FIG. 7 to FIG. 9, a specified one is selected and used as the same medium as the record section 31, and to oppose this projection 40 as the recording medium, the on/off reading switch 34 is disposed on the disc music box body 2 as the reading unit 32 for reading the control information. And, the position of the projection 40 can be checked by attaching a material such as the block member 39 of the fourth embodiment to the projection 40 as the record medium or applying a reflective seal to the projection 40 and disposing a pair of a light emitting diode and a light receiving sensor.

As described above, when one or multiple engaging parts are specified among the engaging parts for playing of the disc, and the specified engaging parts for playing are used as the record medium of control information for controlling other instruments which operate in association with the music box's play, the associated instruments can be controlled directly as the music box plays. As a result, the instruments can be controlled directly or in parallel in association with the music box playing, and the circuit configuration can be simplified.

The above-described respective embodiments do not preclude one another and can be combined appropriately for application. Description has been made with reference to the disc which has the playing holes as the engaging parts for playing, but the invention can also use the above-described disc having the projections and the discs having other arbitrary engaging parts for playing.

Another embodiment which is related to the information disc and its output device of the invention will be described with reference to FIG. 16 to FIG. 23. The basic structures of the information disc and its output device which are common to those of the music box disc and music box instrument to be described afterward will be described first, and then the structures particular to the information disc and its output device will be described.

Specifically, an output device 120 uses an information disc 101 which can be changed easily and quickly to play the music box for actual sounds and directly obtains control information to operate other external instruments in association with the music box's play. For convenience of description, the information disc 101 will be described first in detail.

Figure 18:
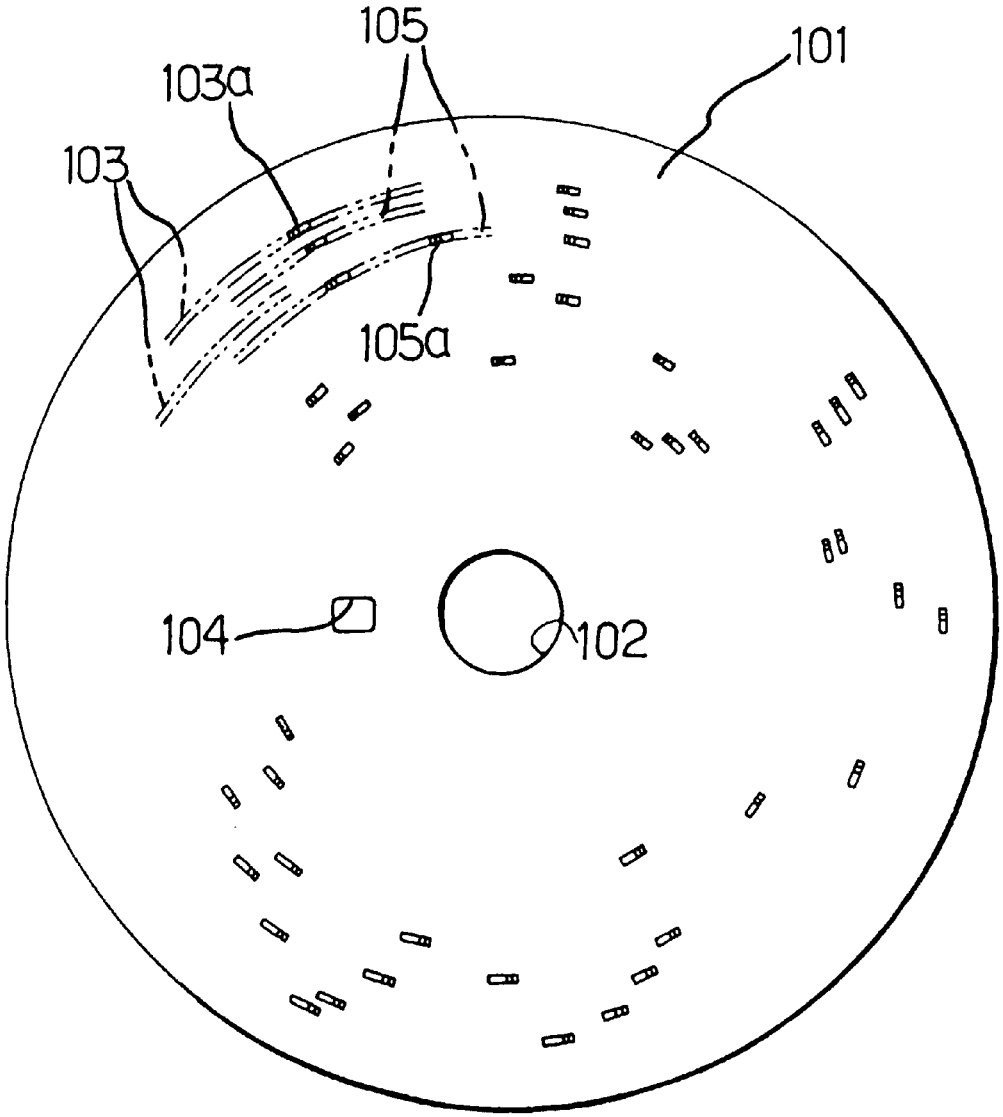
FIG. 18 is a back view showing a schematic entire structure of playing and information tracks of the information disc in the same embodiment.
Figure 19:
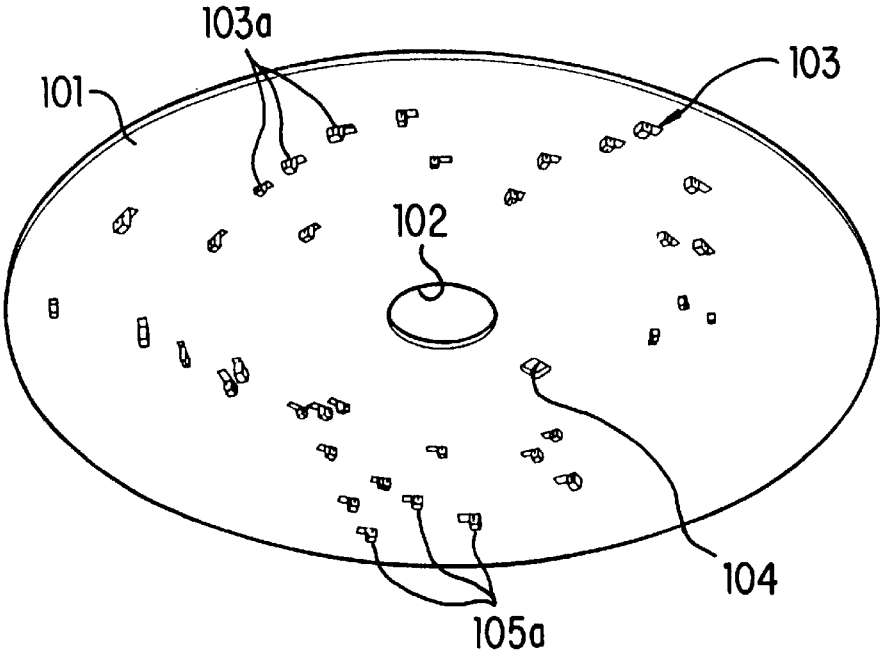
FIG. 19 is an external perspective view showing a schematic entire structure of the back side of the information disc on which playing and information engaging parts are formed in the same embodiment.
Figure 20A:
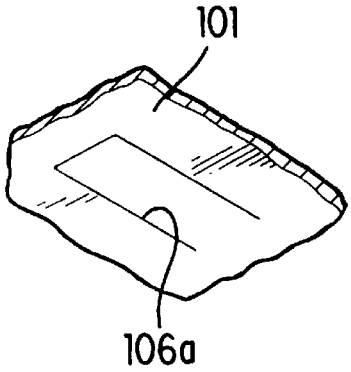
FIG. 20 is to show how a projection is formed as playing engaging part on the disc in the same embodiment, wherein (1) is a perspective view showing a state that an incision is made on the disc, (2) is a perspective view showing a state that the incision is pushed and erected, and (3) is a perspective view showing a state that the erected part is folded double as projection.
Figure 20B:
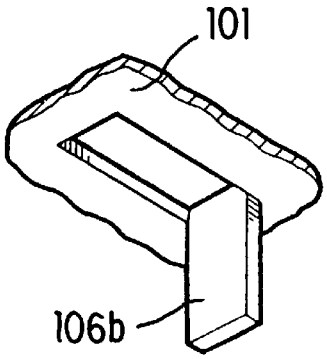
Figure 20C:
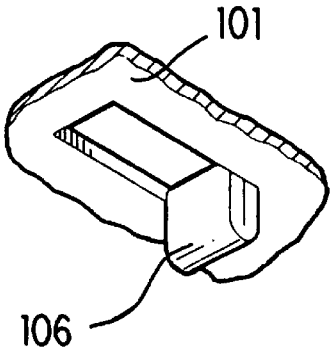

The information disc 101 used by the output device 120 of this embodiment is made of light metal such as an aluminum material formed into a circular plate as shown in FIG. 18 and FIG. 19, given a predetermined rigid strength, and driven to be rotated with reliability by a center drive method. At the rotation center of the information disc 101, a circular fitting hole 102 having a predetermined diameter is formed, and a drive hole 104 which is used to rotate the information disc 101 itself is formed through the disc in the neighborhood of the fitting hole 102 at a predetermined angle. And, the back face of the information disc 101 is divided into a plurality of tracks from the inner to outer peripheries, and these tracks consist of two playing and information tracks 103, 105. Specifically, these playing and information tracks, 103, 105 are formed to have substantially the same width and disposed alternately in the radial direction.

The playing tracks 103 correspond to music box petals 127*a* of a music box sounding member 127 of the output device 120 to be described afterward, and engaging parts 103*a* for playing are formed at positions in the circumferential direction corresponding to the timing of playing musical scales shared by the respective tracks 103, 103. The playing pattern of a given music number is formed by these engaging parts 103*a* for playing. And, the engaging parts 103*a* for playing in this embodiment are of a projection type, and the information disc 101 made of metal has incised and erected parts at appropriate positions to form projections 106. These projections 106 are used as the engaging and driving parts for sounding operation. Specifically, a substantially rectangular U-shaped incision 106*a* is formed (FIG. 20 (1)), this incision 106*a* is pushed and erected as an erected part 106*b* (FIG. 20 (2)), and the erected part 106*b* is folded at its middle to form the projection 106 which protrudes to a predetermined height from the back face of the information disc 101 (FIG. 20 (3)). And, the engaging parts 103*a* for playing are formed sequentially from the inner to outer peripheries of the information disc 101 by an automatic finishing machine.

Since the engaging parts 103*a* for playing are formed as described above, a large number of information discs 101 can be produced by means of simple production jigs and production process. Besides, since the engaging parts 103*a* for playing are formed by folding the erected parts 106*b* at the middle, their height can be adjusted relatively easily. As will be described afterward, the information track 105 for information is provided with engaging parts 105*a* for information similar to the engagement parts 103*a* for playing. The engaging part 105*a* for information is basically formed to have a shape similar to the engaging part 103*a* for playing by a similar production method.

Figure 16:
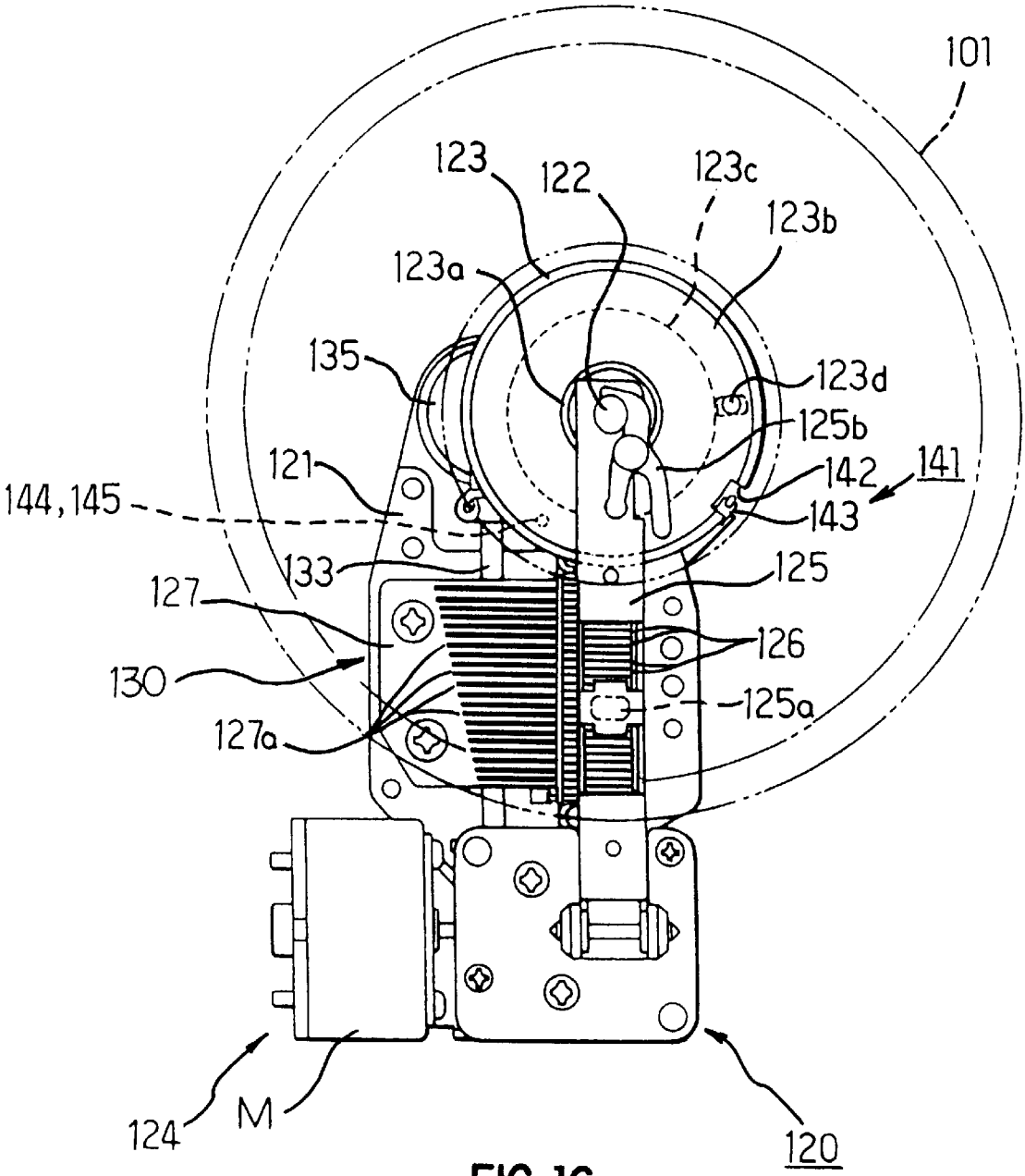
FIG. 16 is a plan view showing a schematic entire structure of an output device using an information disc of the invention.
Figure 17:
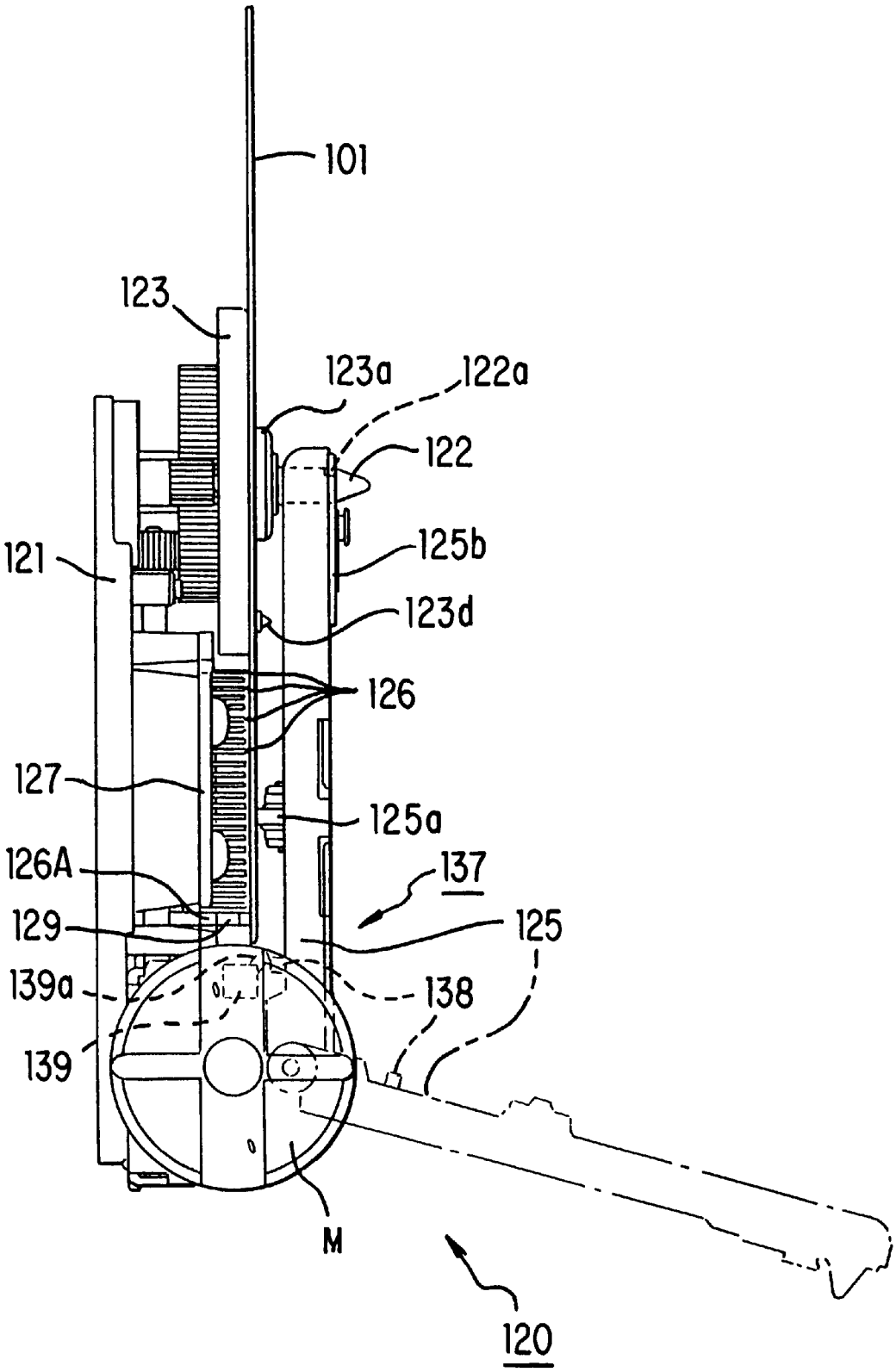
FIG. 17 is a side view showing a schematic entire structure of an output device in an embodiment of the invention.

The output device 120 using the information disc 101 as described above comprises a base 121 which is formed in a substantially flat plate shape having a predetermined plane shape, a turn plate 123 which is rotatably fitted with play to a center shaft 122 which is set up on the base 121, a holding arm 125 which detachably holds the information disc 101 on the turn plate 123, a drive mechanism 124 which drives to rotate the turn plate 123, a sounding mechanism 130 which plays the music box for actual sounds by employing the playing tracks 103 of the information disc 101 which is driven to rotate together with the turn plate 123, and a contact mechanism 160 which obtains control signals associated with the play by employing the information tracks 105 of the information disc 101 as shown in FIG. 16 and FIG. 17.

The base 121 is made of a material having a high rigid strength to be longer than at least a radius of the information disc 101, has at its one end in the longitudinal direction the turn plate 123 to hold and rotatably support the information disc 101 by a shaft and at the other end a motor M for the drive mechanism 124, and among them are disposed a transmission shaft 133 and gears 132, 134, 135 of the drive mechanism 124 to decelerate and transmit the rotation output of the motor M to the turn plate 123 while playing the music box. And, thread holes are formed at predetermined positions of the base 121 to firmly mount the output device 120 to a timepiece body 110.

This turn plate 123 is fitted with play to the center shaft 122 made of metal disposed on the base 121 and rotatably supported by it, and an E ring is fitted on the side of the leading end of the turn plate 123 to prevent it from coming out of the center shaft 122. And, the turn plate 123 is made of a synthetic resin in the form of a thick circular plate, a fitting part 123*a* having an outer diameter corresponding to the inner diameter of the information disc 101 is disposed on the side of its leading end, a supporting part 123*b* having a diameter larger than the fitting part 123*a* and stably supporting the lower surface of the information disc 101 is formed at its middle, and a gear part 123*c* engaged with the second gear 135 which is an output gear of the drive mechanism 124 is disposed on the side of the base end. And, a drive projection 123*d* is projected on the upper part of the turn plate 123 at the position corresponding to the drive hole 104 of the information disc 101.

In the drawing, 129 is a supporting member which is made of a synthetic resin and disposed to correspond to the outer periphery of the information disc 101. The turn plate 123 supports the inner periphery of the lower face of the information disc 101, and the supporting member 129 supports the outer periphery of the lower face of the information disc 101, so that the rotation of the information disc 101 can be made smooth and stable. And, the supporting member 129 may not be a stationary member but a rotating member. Besides, the turn plate 123 is connected to the drive mechanism 124 which drives to rotate the turn plate 123 in a predetermined rotating direction at a predetermined speed when the music box is playing.

Figure 21:
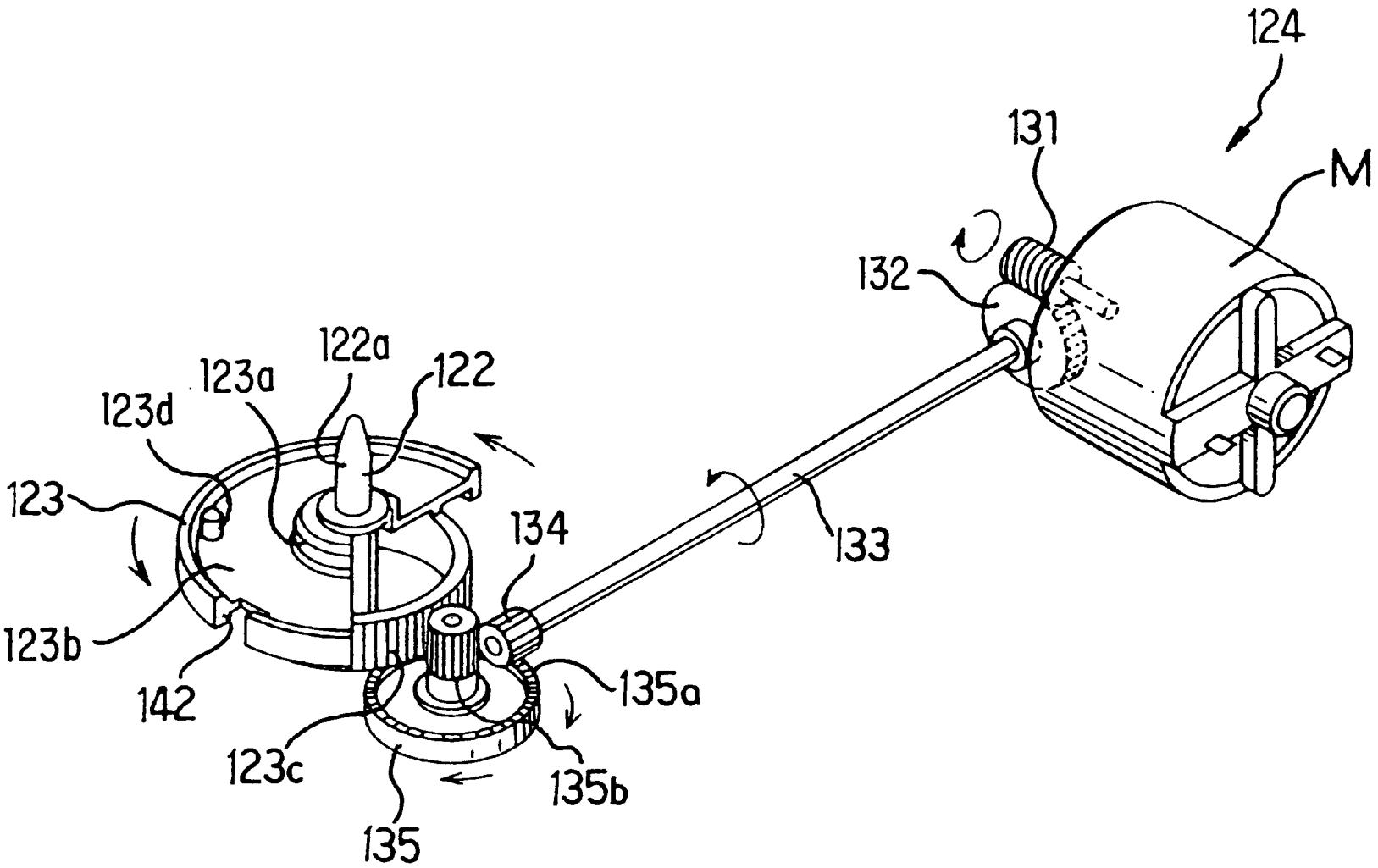
FIG. 21 is a perspective view showing a drive mechanism with partial omission for the music box disc in the same embodiment.
Figure 22A:
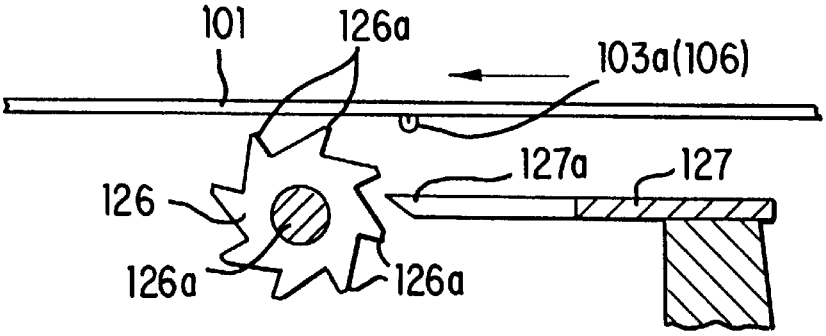
FIG. 22 is to illustrate how a sound producing mechanism operates to produce a sound in the same embodiment, wherein (1) shows a state ready to produce a sound, (2) shows an initial state that a pick of the star wheel is engaged with a playing engaging part of the information disc, (3) shows a state that a music box petal is plucked by a pick of the star wheel to produce a sound, and (4) shows a state restored to be ready to produce a sound.
Figure 22B:
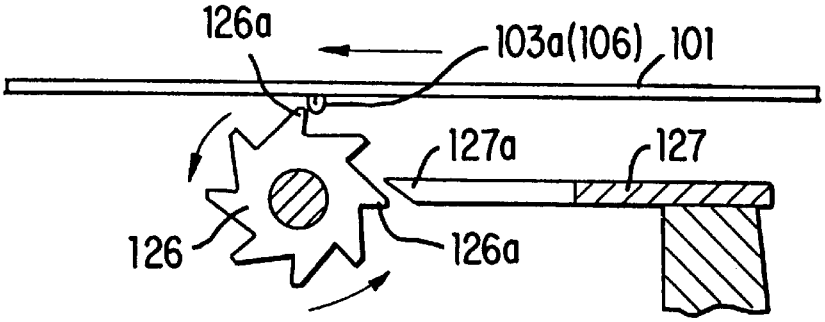
Figure 22C:
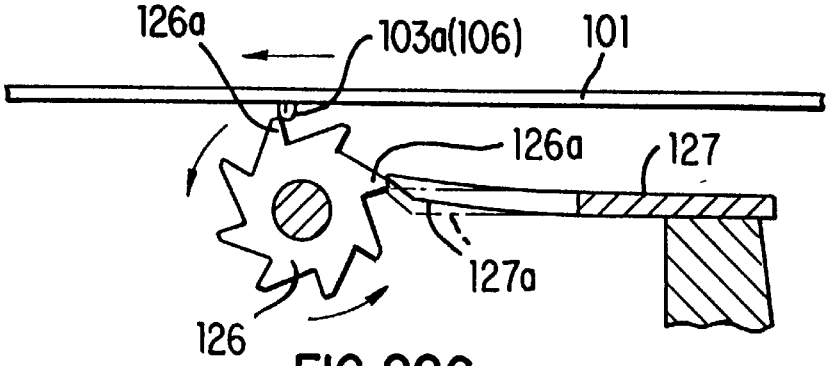
Figure 22D:
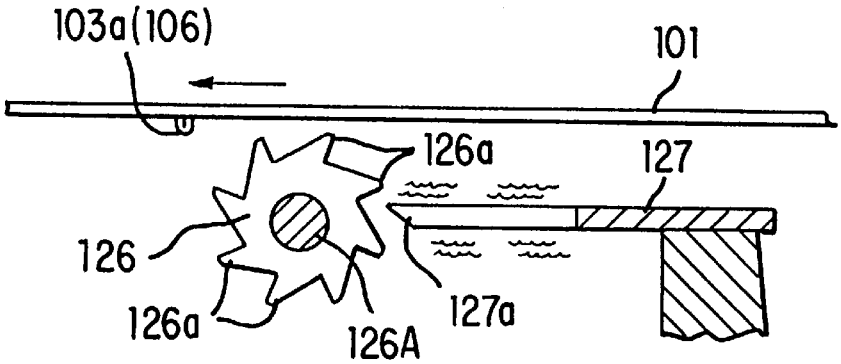

As shown in FIG. 21, the drive mechanism 124 comprises the motor M which is disposed so as to be located outside the information disc 101 when the information disc 101 is fitted to the turn plate 123, and the first input gear 132, the transmission shaft 133, the first output gear 134 and the second gear 135 which decelerate and transmit the rotational output of the motor M to the turn plate 123 on the side of the inner periphery of the information disc 101. The motor M is a DC motor and fixed to the base 121 to locate outside the information disc 101 with the motor shaft in parallel to the plane of the base 121 and orthogonal to the longitudinal direction of the holding arm 125. Therefore, the motor M can be held stably on the plane of the base 121, and the overall thickness of the output device 120 can be made substantially minimum, namely a height corresponding to about the motor diameter, so that the output device 120 can be made thin.

A connection terminal of the motor M is connected to a motor drive circuit (not shown), and the motor M is driven by a drive current supplied from the motor drive circuit. And, the motor M is configured not to operate when the holding arm 125 is not locked by a safety switch mechanism 137 as will be described afterward. And, a worm gear 131 is fixed to the output shaft of the motor M, and the first input gear 132 is engaged with the worm gear 131. The first input gear 132 is fixed to one end of the transmission shaft 133 which is orthogonal to the longitudinal direction of the motor's output shaft and supported in parallel to a star wheel shaft 126A. And, the first output gear 134 is fixed to the other end of the transmission shaft 133. The first output gear 134 is engaged with an input gear 135*a* of the second gear 135, and an output gear 135*b* which is integrally formed with the second gear 135 is engaged with the gear 123*c* which is integrally formed with the base end of the turn plate 123.

The second gear 135 is provided with the input gear 135*a* and the output gear 135*b* which are orthogonal to it and formed integrally. The input gear 135*a* has a substantially circular outer periphery rim protruded in the axial direction and gear teeth formed on the protruded end face so as to engage with the first output gear 134. And, the output gear 135*b* of the second gear 135 is an external tooth having a predetermined diameter coaxial with the input gear 135*a* and on its inner periphery, and engaged with the gear 123*c* which is integrally formed at the base end of the turn plate 123. Therefore, the rotation of the first output gear 134 is reduced and transmitted to the turn plate 123 which is disposed on the base 121 in a direction orthogonal to the rotation shaft of the output gear 134.

Besides, a predetermined deceleration ratio is determined between these gears 131, 132, 134, 135*b*, 123*c* engaged one another. Therefore, the rotating drive force of the motor M is transmitted to the turn plate 123 while being decelerated to a predetermined speed by the drive mechanism 124, and the information disc 101 fitted to the turn plate 123 is rotated at a predetermined rotational speed.

As shown in FIG. 16 and FIG. 17, the holding arm 125 is formed in a substantially long plate which is longer than at least the radius of the information disc 101, with its base end supported on the base 121 with a shaft and its leading end formed to be engageable and lockable to the center shaft 122 erected from the base 121, and provided with a roller 125*a* which pushes while rotating the information disc 101 against the star wheels 126 on the side of the base 121. Specifically, a notch 122*a* is formed on the tip of the center shaft 122 where the holding arm 125 is engaged, a lock arm 125*b* having a predetermined shape is disposed on the pertinent part of the holding arm 125 according to the notch 122*a*, and the lock arm 125*b* is pushed by a spring to have its end engaged with the notch 122*a*.

Therefore, unless the engagement of the lock arm 125*b* is released by the user, the information disc 101 is fitted to the output device 120 and securely held. The information disc 101 is stably held regardless of the position of the output device 120 itself to enable the music box play. On the other hand, releasing the holding arm 125 for its lock and tilting it to erect, the information disc 101 can be changed quickly and easily.

Besides, this embodiment has a safety switch mechanism 137 to check that the holding arm 125 is locked or not. Specifically, as shown in FIG. 17, the safety switch mechanism 137 comprises a projection 138 disposed on the holding arm 125 at a position outside of the information disc 101 of the holding arm 125 to oppose in the direction of the information disc 101, and a microswitch 139 having a rising/falling switch lever 139*a* disposed on the base 121 at a predetermined position to correspond to the projection 138. This microswitch 139 is electrically connected directly to a signal wire for transmitting a start signal to start the music box play.

The microswitch 139 is fixed to the base 121 to correspond to the projection 138, and has on its top the general rising/falling switch lever 139*a* and on its base an electrical switch contact terminal. The switch lever 139*a* is pushed to stand upward by a spring or the like, and when it is stood, the switch is electrically turned off, and when the switch lever 139*a* is fallen, the switch is turned on. Therefore, when the holding arm 125 is opened, the projection 138 formed on the holding arm 125 is separated from the microswitch 139, the switch lever 139*a* of the microswitch 139 is stood to turn off the switch, and the output device 120 is prevented from operating. On the other hand, when the holding arm 125 is locked, the projection 138 of the holding arm 125 becomes close to the microswitch 139, the switch lever 139*a* is fallen to turn on the switch 139, and the output device 120 becomes operable.

In addition, it can be configured so that the set condition of the information disc 101 can be determined at the same time. Specifically, the microswitch 139 which has the switch lever 139*a* protruded by a predetermined level toward the information disc 101 may be disposed in the same way at a position of the holding arm 125 opposed to the information disc 101, and the microswitch 139 is connected to the control circuit. Therefore, when the holding arm 125 is opened, the switch lever 139*a* of the microswitch 139 stands to prevent the music box from operating, but when the holding arm 125 is locked without fitting the information disc 101, the switch lever 139*a* does not come in contact with the information disc 101, so that the switch lever 139*a* is in an erected state, and the output device 120 is prevented from operating.

Accordingly, by virtue of the safety switch mechanism 137, a malfunction with the music box disc not fitted can be prevented, and even when the lock of the holding arm 125 is released while the music box is playing by accident or by the user as required, the operation of the music box can be stopped immediately, any damage or personal injury can be prevented, and safety can be improved.

In particular, the information disc 101 of this embodiment is relatively small, but if a larger disc is used for example, the drive motor can be stopped immediately when the safety switch mechanism 137 of this embodiment is disposed, and sufficient safety can be secured. Specifically, since a relatively powerful drive motor is used to drive to rotate a large disc and it is hard to deal with by human power, it is necessary to prevent the motor from causing a malfunction excepting when the operation is normal, but the safety switch mechanism 137 can deal with sufficiently.

And, the sounding mechanism 130 comprises the star wheels 126 which are engaged with the engaging parts 103*a* for playing of the information disc 101 to be driven to rotate in association with the turn plate 123 which is driven to rotate by the drive mechanism 124, and the music box sounding member 127 having the music box petals 127*a* driven to sound by the star wheels 126.

Specifically, in FIG. 16 and FIG. 17, the music box sounding member 127 for the sounding operation of the music box is formed of a metal material to have a long plate shape and disposed on the base 121 in parallel to the information disc 101. The leading end at one end of the music box sounding member 127 has the music box petals 127*a* formed in the form of comb teeth, and the base end on the side of the other end is fixed to a seat disposed on the base 121 so that the end on the side of the music box petals 127*a* is aligned in the radial direction of the information disc 101 corresponding to the holding arm 125. And, these music box petals 127*a*, 127*a* are disposed in a predetermined number corresponding to the number of musical scales to be sounded, and formed to have predetermined thickness and length corresponding to the musical scales. When the tips of the music box petals 127*a*, 127*a* are plucked, music box sounds are produced at predetermined musical scales/musical intervals.

And, the plurality of star wheels 126 corresponding to the number of musical scale tracks of the information disc 101 are rotatably supported by the star wheel shaft 126A at the position on the side of the lower surface of the information disc 101 with respect to the holding arm 125. These star wheels 126 have eight picks 126*a* formed at equal intervals on their outer peripheries so that they can be engaged with the engaging parts 103*a* for playing of the information disc 101 regardless of their rotating positions. These picks 126*a* are formed to have an acute sloped surface on their front sides in the rotating direction but to have on their back sides a surface orthogonal to the rotating direction, so that the engagement with the engaging parts 103*a* (projections 106) for playing of the information disc 101 can be made with reliability.

As compared with the perforated type, since the engagement parts 103*a* of the information disc 101 are formed by protruding, it is not necessary to operate for arranging the picks 126*a*, 126*a* of all the star wheels 126 in a row or to push the star wheels 126 in the rotating direction to engage the respective picks 126*a* with the holes with reliability, and the structure can be made simple.

And, a synthetic resin useful to reduce friction is used to dispose a separating member having a gap of a predetermined width in the number same to the star wheels 126 at the base 121 opposed to the respective star wheels 126 to keep a predetermined interval along the longitudinal direction of the star wheel shaft 126A of the respective star wheels 126. Therefore, the respective star wheels 126 can keep the position always rotatable and opposed to the music box petals 127*a* of the corresponding music box sounding member 127.

And, after the information disc 101 selected by the user as desired is fitted to the base 121, an activation signal is output from a control circuit (not shown) on the hour or the like or a monitor switch (not shown) is turned on by the user, the information disc 101 is driven to rotate by the drive mechanism 124, and the music box petals 127*a* corresponding to the musical scales of a music number are plucked by the picks 126*a* of the star wheels 126 at a predetermined timing to play the music box.

Specifically, the projections of the respective engaging parts 103*a* for playing of the information disc 101 catch the picks 126*a* of the star wheels 126 corresponding to the engaging parts 103*a* for playing to force the star wheels 126 rotate, and the music box petals 127*a* are finally plucked by the subsequent other picks 126*a* of the rotating star wheels 126 to produce the music box sounds.

As shown in FIG. 22, the information disc 101 is driven to rotate (FIG. 22 (1)), the engaging part 103*a* for playing is engaged with, for example, the pick 126*a,* among the picks 126*a* of the star wheel 126 (FIG. 22 (2)), the pick 126*a* is forced to move by the projection 6 of the engaging part 103*a,* and the star wheel 126 is rotated. At the same time, the pick 126*a* subsequent to the pick 126*a* of the star wheel 126 comes in contact with the music box petal 127*a* (FIG. 22 (3)) and further moves to pluck the music box petal 127*a* (FIG. 22 (4)), as a result, the music box sound particular to the music box petal 127*a* is produced.

Besides, an auto-stop mechanism 141 is disposed to automatically stop the information disc 101 after one turn, thereby enabling to apply to a trick timepiece or the like (FIG. 16). In other words, it is configured that when the music box's play completes a single music number corresponding to one turn of the information disc 101, the motor M stops its operation automatically. This auto-stop mechanism 141 comprises a notch 142 for detecting formed on the turn plate 123 and a microswitch 143 for detecting disposed at a predetermined position on the base 121.

And, to enable the auto-stop mechanism 141, positioning holes 144, 145 for positioning and incorporating the rotation position of the turn plate 123 at a position to detect one turn by the microswitch 143 are disposed on the base 121 and the turn plate 123. Specifically, since the drive hole 104 of the information disc 101 is engaged with the drive projection 123*d* disposed on the turn plate 123 to fit the information disc 101 to the turn plate 123, the information disc 101 is kept fitted at a constant turning angle to the turn plate 123. Therefore, the play starting position of the information disc 101 fitted to the turn plate 123 is kept constant with respect to the base 121, and the music box cannot start to play or complete even when the relational position between them is slightly deviated.

Specifically, when the turn plate 123 is driven to rotate and the notch 142 of the turn plate 123 reaches the position where it is detected by the microswitch 143, the rotational position of the information disc 101 which rotation is restricted by the drive projection 123*d* of the turn plate 123 is always required to be at the play termination position (hereinafter called the rotation standard position). Specifically, as shown in FIG. 16 and FIG. 17, since the auto-stop mechanism 141 comprises the notch 142 formed to a predetermined length in the circumferential direction on the outer periphery of the supporting part 123*b* of the turn plate 123 and the microswitch 143 disposed at a predetermined position on the base 121 which is a disc music box fixing side member, the turn plate 123 is assembled with a pin engaged with the positioning holes 144, 145 formed on the base 121 and the turn plate 123, so that the turn plate 123 can be disposed at a proper rotation standard position.

When the position where the microswitch 143 is disposed and the position where the notch 142 is formed are vertically matched mutually with the position of the drive projection 123*d* on the turn plate 123 as the reference, the rotation position of the information disc 101 by the drive projection 123*d* is determined to be a start or completion position of playing. And, a distance between the microswitch 143 and the lower surface of the supporting part 123*b* of the turn plate 123 is set to be shorter than the overall length of its switch lever, namely a distance that the switch lever is contacted to and tilted by the lower surface of the supporting member 123*b* at the rotation position during the music box's play. Besides, the microswitch 143 makes a reverse operation that it outputs an off signal when the switch lever falls, and outputs an on signal when the switch lever stands.

In addition, the output terminal of the microswitch 143 in the ordinary setting may be connected externally through a reverse circuit which inverts the output signal. Besides, the notch 142 formed on the supporting member 123*b* of the turn plate 123 is formed to have a predetermined length in the circumferential direction to detect with reliability at a position on the outer periphery of the supporting part 123*b* and satisfying the above-described conditions.

Therefore, while the music box is playing, the turn plate 123, namely the information disc 101, is driven to rotate and reached the standard rotation position to terminate playing after one turn, the notch 142 formed on the supporting part 123*b* of the turn plate 123 is positioned just above the microswitch 143, the switch lever of the microswitch 143 stands up, and an on-state detection signal is output from the microswitch 143. According to this detection signal, the information disc 101 can be stopped rotating by the control circuit. Thus, the auto-stop mechanism 141 can be achieved.

And, since the turn plate 123 is used to detect without forming a formed part such as a pick or hole for detecting one turn on the information disc 101 itself, the information disc 101 can be produced easily in a large quantity, and it is possible to prevent the possibility that the rotation stopped position cannot be detected if the formed part is on the disc but damaged.

The positioning holes 144, 145 are not limited to a through hole but may be an appropriate hole such as a bag hole or a notch. It is to be understood that the engaging part used for positioning, such as a through hole, a bag hole, or a notch, is called the positioning hole in this specification. And, once assembled, the turn plate 123 is engaged with the output gear of the drive mechanism 124, so that the mutual relation, namely the rotational position, can be prevented from being deviated.

Now, description will be made of the engaging parts 105*a* for information disposed on the information tracks 105 and the contact mechanism 160 as the output control device to obtain control information from the engaging parts 105*a* for information.

As shown in FIG. 18, the information disc 101 of this embodiment has the playing tracks 103 corresponding to respective musical scales having a predetermined number of engaging parts 103*a* arranged from inner to outer peripheries for playing and the information tracks 105 having a predetermined number of engaging parts 105*a* for information disposed alternately, and the information track 105 is used alone or in combination to obtain control information for other instruments.

Accordingly, since the playing and information tracks are alternately disposed on the information disc, the respective engaging parts and contact movable parts of a sounding/contacting mechanism to obtain sounding and signal by the engaging parts disposed on these tracks can be configured with an appropriate interval therebetween. Therefore, designing can be made without due stress, and a low cost and sufficient reliability can be secured. For example, a general microswitch can be used as the engagement detecting mechanism of a contact mechanism 160 for detecting the engaging parts, thus the cost reduction and reliability can be improved.

And, the engaging parts 105*a* for information disposed on the information tracks 105 are different depending on an instrument to be controlled according to the information tracks 105. But, they are basically disposed corresponding to the sounding timing of predetermined musical scales.

For example, with the sounding timing of a certain musical scale as reference, a certain engaging part 105*a* for information is disposed with a cycle phase changed by ½ of the information disc 101 so that the disc is driven to rotate satisfactorily.

And, this engaging part 105*a* for information is slightly displaced forward of the rotating direction taking into account a time lag before a sound is actually output from the instrument according to the obtained control signal. Therefore, since the sounding operation by another instrument is synchronized at sufficient accuracy with the sounding by the music box, control can be made strictly at high accuracy.

Besides, since the portion on the side of the outer periphery of the information disc 101 has a long distance in the rotating peripheral direction, it is assigned for the control track to control an instrument which requires higher accuracy or to record control information at higher density.

The control information formed of the engaging part 105*a* for information disposed on the control tracks can be set as required to synchronize with all music box sound productions or to synchronize with beat sounds only. And, the instrument can be controlled regardless of the sounding timing of the music box's play. For example, even while the play is stopped, it is possible to make flexible control depending on instruments so that an instrument can be operated as required for preparing or the like.

Figure 23:
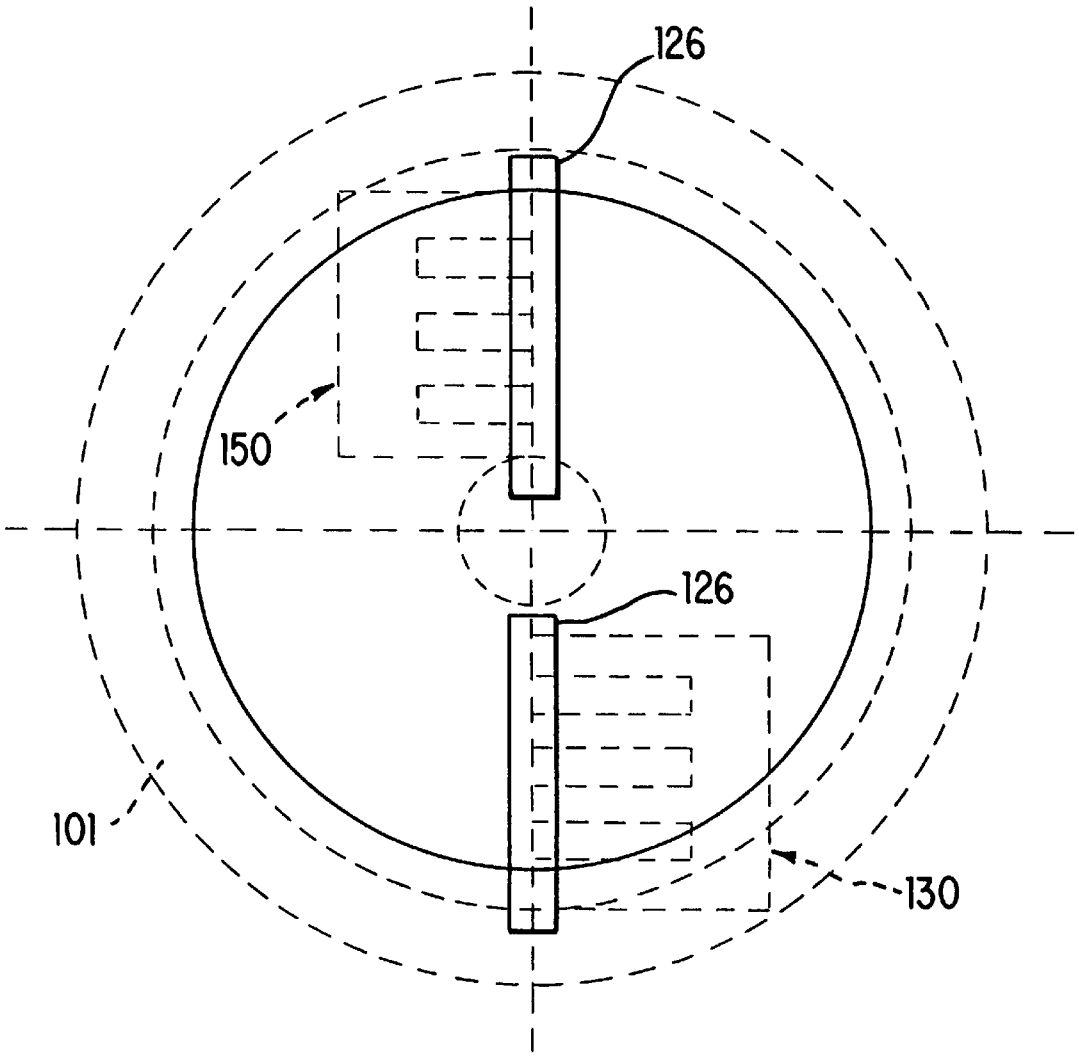
FIG. 23 is a conceptual diagram related to another embodiment of the invention.

Furthermore, it may be configured to use a single information track 105 by switching in accordance with the rotation cycle. Specifically, when the music box's play consists of three parts of a prelude theme, a main theme and an ending theme, the control signal obtained from the same information track can be switched and used for another instrument for each theme. And, the contact mechanism 160 for detecting the engaging part 105*a* for information to output a control signal is a general mechanical detecting mechanism having a microswitch and the like as shown in FIG. 23 for example, and provided with an electrical contact operated by the engaging part 105*a* for information. The output terminal of the contact is directly connected to a drive circuit for an associated instrument (not shown) or connected to an integrated control circuit for integrally controlling each instrument.

Specifically, in the same way as the music box petals 127*a* of the music box sounding member 127, the switch group is disposed so that the switching operation is made by the engaging projections 106 of the information disc 101 through the star wheels 126. In this case, turning on and off are made by the rotation of the star wheels 126, an engaging projection 106 with a height adjusted for switching only may be formed separately.

Therefore, the contact mechanism 160 can be assembled with the same accuracy as the sounding mechanism 130, processability and assembling ability can be improved, switching operation can be made with the same accuracy as the sounding timing of the music box sounding member 127, and the switch signal can be used as a reference signal for various and high-level controlling.

And, the contact mechanism 160 is disposed on the base 121 of the output device 120 at a position deviated by a ½ phase cycle in the rotating phase cycle of the information disc 101. And, the respective contact detecting positions are configured to align with the engaging positions by the star wheels 126 of the sounding mechanism 130 on substantially the same line.

Specifically, a position where the star wheels 126 of the sounding mechanism 130 are engaged with the engaging parts for playing of the information disc 101 and a position where the star wheels 126 of the contact mechanism 160 are engaged with the engaging parts for information of the information disc 101 are arranged to be on substantially the same axially symmetric line with respect to rotating center axis of the information disc 101.

Therefore, since the play and control information is obtained from the positions always arranged on the line with respect to the information disc 101, the information disc 101 is pushed satisfactorily, and the rotational drive of the disc can be retained smoothly and satisfactorily. And, a sufficient space for disposing the contact mechanism can be secured without decreasing the existing space for disposing the sounding mechanism, and they can be disposed without due stress.

The disposition of the sounding mechanism 130 and the contact mechanism 160 is not limited to the above, and they can be disposed at an interval of 120 degrees in the circumferential direction when they are suitably combined to have three sounding mechanisms 130 or contact mechanisms 160.

Therefore, the engaging parts 103*a* for playing and the engaging parts 105*a* for information dedicated for the associated instruments are disposed on the same information disc 101 to control directly the instrument associated with playing, so that detailed and flexible control can be improved.

Description will be made of operation control of the output device 120 using the information disc 101.

First, when the monitor switch is turned on by the user or it becomes a predetermined time, predetermined music box's play and operation of an instrument associated with the play are started.

Specifically, the motor M is driven as predetermined by the motor control circuit of the output device 120, and the information disc 101 is driven to rotate from the play starting position in the forward direction by the motor drive. And, as the information disc 101 rotates, the engaging parts 103*a* for playing disposed at predetermined positions of the play tracks 103 of the information disc 101 catch the picks 126*a* of the corresponding star wheels 126 to force the star wheels 126 rotate. The music box petals 127*a* of the music box sounding member 127 are plucked by other picks 126*a* subsequent to the rotating star wheels 126 to produce predetermined music box sounds.

At the same time, the engaging parts 105*a* for information disposed at the predetermined positions of the information tracks 105 of the information disc 101 reach the position where detection is made by the contact mechanism 160, a control signal is output from the contact mechanism 160, and the subsequent instrument is operated through the drive circuit and the control circuit. In other words, the subsequent associated instrument is controlled to be driven appropriately in association with the music box's play to make synchronized operation as determined with the sounding timing.

Lastly, after the information disc 101 is driven to make one turn as determined, the music box's play is terminated. Specifically, the auto-stop mechanism 141 operates to stop the information disc 101 at the initial rotation position where the music box starts to operate.

The contact mechanism 160 used in this invention is not limited to a particular one as far as the smooth rotation of the disc is not disturbed and sufficient durability can be secured, and general and inexpensive various types of switches may be used.

The above embodiment has been described in relation to a case of controlling an instrument based on the music box's play. But, it may be configured reversely that the music box's play is made based on the operation of the instrument. Besides, both ways may be combined in parallel mutually to provide integral controlling effects.

As described above, by the information disc of this embodiment, the playing tracks where the engaging parts for playing are disposed to produce actual sounds of the sounding member and the information tracks where the engaging parts for information of the instruments associated with the playing are disposed on the same information disc, and the associated instruments can be controlled directly in association with the play of actual sounds, so that the instruments can be controlled directly and in parallel in association with the play of actual sounds, and the circuit configuration can be simplified.

And, since the playing tracks and the information tracks are alternately disposed on the information disc, the respective engaging parts and contact movable parts of a sounding/contacting mechanism to obtain sounding and signal by the engaging parts disposed on these tracks can be configured with an appropriate interval therebetween. Therefore, designing can be made without due stress, and a low cost and sufficient reliability can be secured.

Besides, since the sounding mechanism and the contact mechanism are symmetrically disposed with respect to the information disc's rotation axis, the engaging positions for obtaining playing and control information are arranged to align in a range of substantially a single line with respect to the information disc. Therefore, the information disc is in a satisfactory pushed state, its rotational drive can be kept smooth and good, a disposing space sufficient for the sounding/contacting mechanism can be secured, and they can be disposed without due stress.

Since the control information for an instrument variable for each disc can be recorded and the disc can be exchanged readily, the operation of the instrument can be changed flexibly in addition to the change of a music number according to a situation. For example, by providing discs having the same music number but also different control information in advance, the interconnected instrument can be operated in a different way while playing the same music number by changing the discs quickly and readily.

In addition, even when the rotation speed of the playing disc, namely the rhythm of the music number, is changed, the equipment operation can be followed automatically.

Now, description will be made of the information disc of the invention and its device with reference to another embodiment shown in FIG. 24. The output device 120 using the information 101 of this embodiment has a music box sounding member separate from the sounding mechanism 130 incorporated into the contact mechanism 160.

Figure 24:
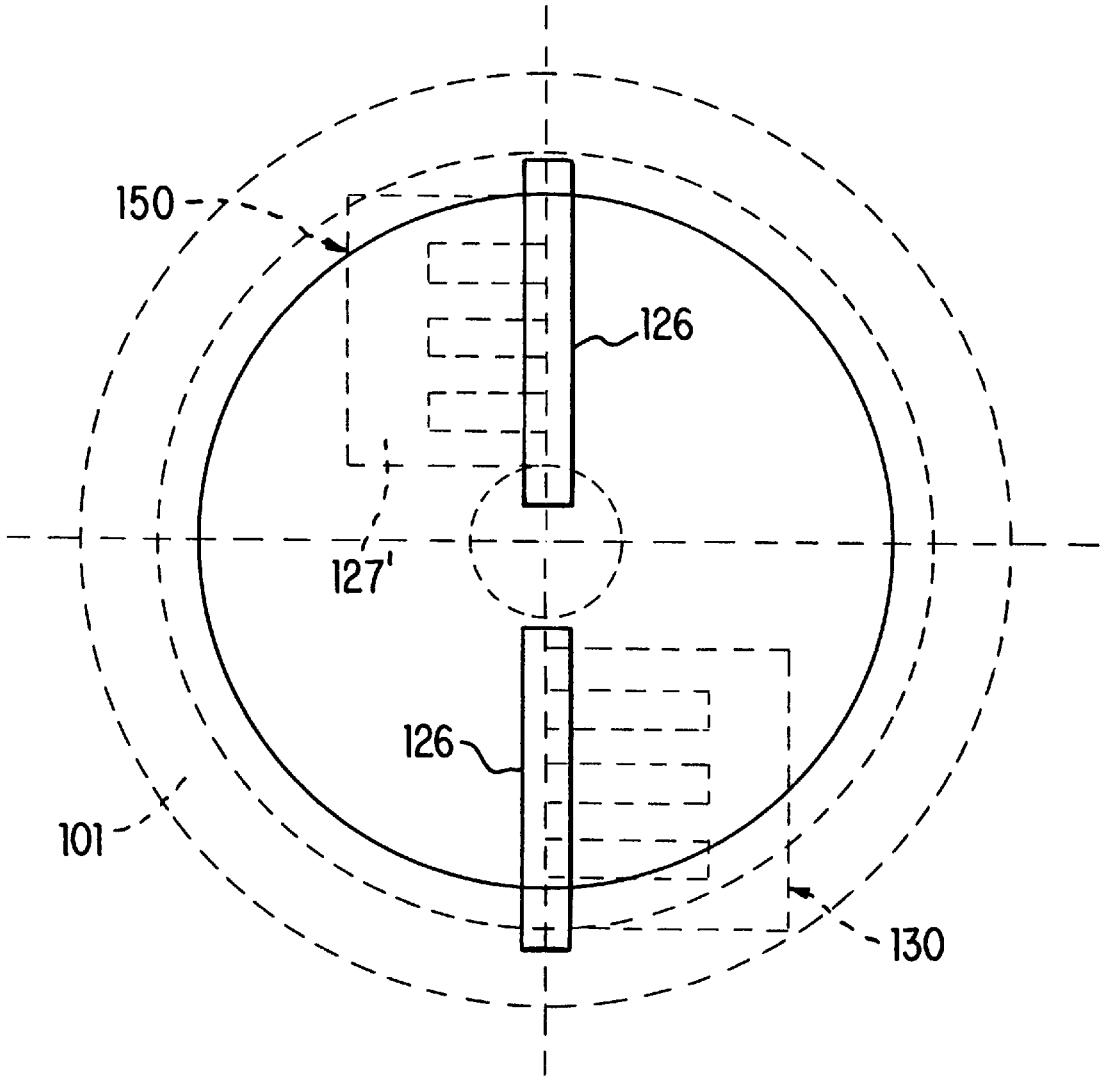
FIG. 24 is a conceptual diagram related to another embodiment of the invention.
Figure 25:
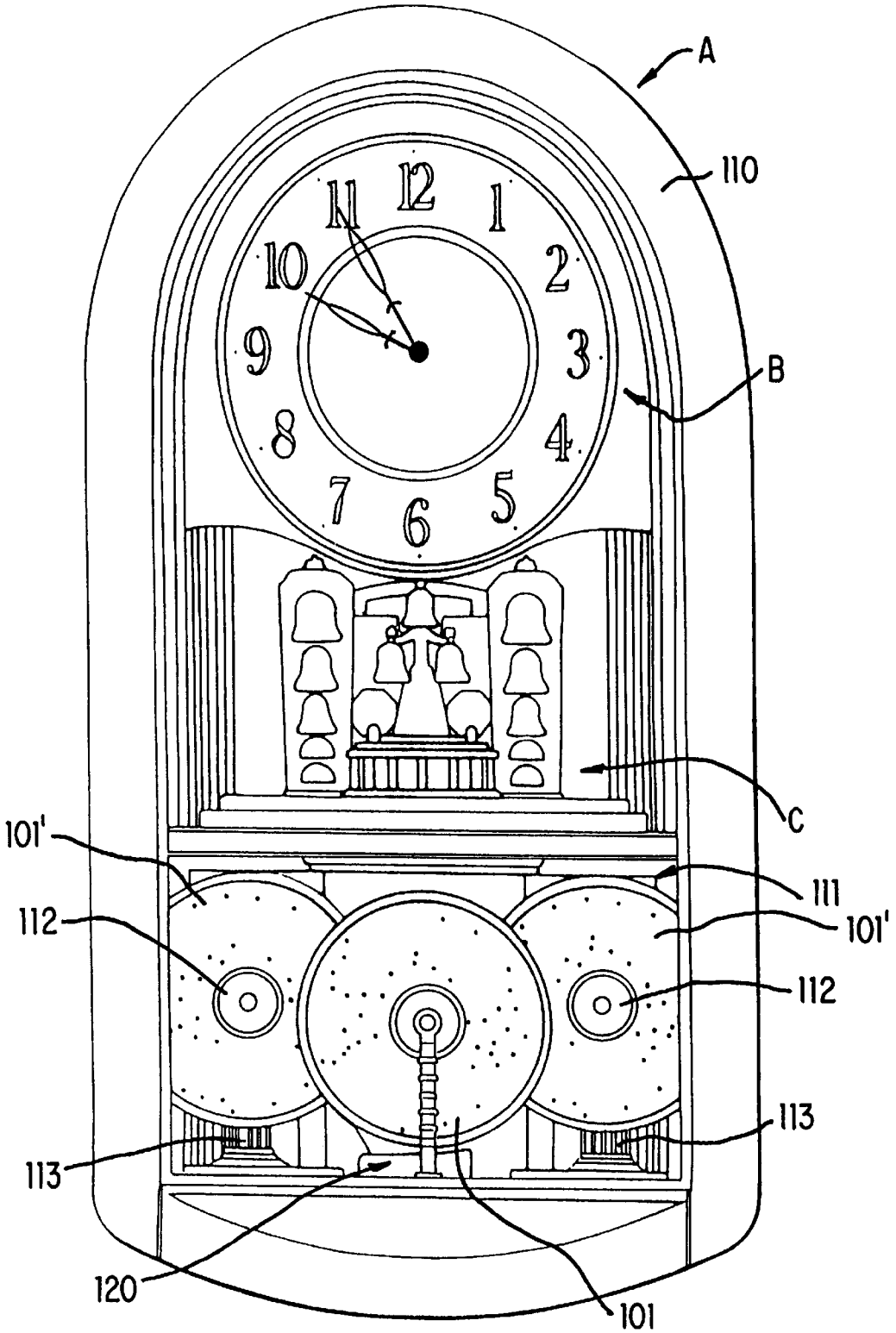
FIG. 25 is a front view showing an entire structure of a trick timepiece in an embodiment of the invention.

Specifically, as shown in FIG. 24, a music box sounding member 127' having the music box petals 127*a* is disposed on the side of the inner periphery of the contact mechanism 160, and the information tracks on the inner periphery of the corresponding information disc 101 are used as the playing tracks 103 and provided with engaging parts for playing.

This music box sounding member 127' may be the music box sounding member 127 of the sounding mechanism 130 and a sounding member which is made of a different material in a different shape to produce apparently different tunes, and it can be used for playing the accompaniment or prelude of a music number to further improve the power of expression of the music box's play.

And, since the outer periphery of the information disc 101 having a long distance moving in the peripheral direction is allocated for the information tracks 105, control information can be recorded and obtained at higher density and higher accuracy.

As described above, this embodiment provides the same effects as the above-described embodiments and also can increase the number of musical scales, use different tones and can further enhance the power of expression of the music box's play.

In addition to the contact mechanism 160 using the above-described general mechanical detection mechanism, the present invention can use an appropriate output control device such as an optical reading mechanism.

Now, description will be made of the trick timepiece of the invention with reference to an illustrated embodiment.

As shown in FIG. 25 to FIG. 28, a trick timepiece A of this embodiment is a wall type to be mounted on a wall, and comprises a timepiece mechanism B which is disposed at the upper part of a clock body 110 and has a dial plate 107, a disc music box instrument (output device) 120 which is disposed below the timepiece mechanism B, a rotating decoration C which is disposed between them and at the center, and a tricky device 150 which is generally concealed behind the dial plate 107.

Specifically, this clock body 110 is formed in a flat box having a round top, and has a fixture 110*a* at the top end of its back to mount the trick timepiece A on a wall. And, this clock body 110 has the timepiece mechanism B to indicate the present time on the front upper part.

This timepiece mechanism B comprises the dial plate 107 having a circular plate shape of a predetermined diameter, a clock movement 107A disposed at substantially the center of the back of the dial plate 107, a clock shaft 107*a* which is disposed to pass through from the clock movement 107A to the dial plate 107, clock hands 107*b* (hour and minute hands) with their bases fixed to the clock shaft 107*a*. The clock movement 107A houses a clock mechanism for driving the clock hands 107*b* and it is configured to output an hour signal to the tricky device 150 on the hour determined in advance.

Therefore, the clock shaft 107*a* having the clock hands 107*b* is driven to rotate as determined by the clock mechanism within the clock movement 107A to indicate the present time by the clock hands 107*b* (hour and minute hands) which are moved to a predetermined rotating angle on the dial plate 107.

Besides, the turning decoration C which always turns to invert slowly is disposed just below the dial plate 107 to enhance a decorative effect as the timepiece.

This turning decoration C comprises an axially symmetrical decoration member 109 having crystal or the like and a rotating decoration driving mechanism (not shown). This decoration member 109 is fixed to a pivotally supported shaft which is vertically disposed on the turning decoration driving mechanism. And, the decoration driving mechanism is fixed to the clock body 110 and houses an inverting mechanism using a motor or the like to drive to invert the pivotally supported shaft as predetermined. Therefore, the turning decoration member 109 is disposed to be inverted slowly and turned by this turning decoration driving mechanism.

And, a disc music box instrument (output device) 120 is vertically disposed just below the turning decoration C, namely it is disposed to direct the top face of a fitted disc 101 toward the front face of the timepiece A, so that the disc 101 and its turning movement can be always seen from the front of the trick timepiece A, thereby improving the external appearance as a part of the decoration of the timepiece and facilitating the exchange of the disc.

This clock body 110 comprises a front member 11OA having a transparent glass pane and a back member 10B. These members 110A, 110B are connected by a hinge fixture 110C. Therefore, the disc music box instrument 120 is protected by this openable member 110B, and the disc 101 can be changed quickly.

And, a space 111 where a disc 101 can be housed is provided on the back and both sides of the vertically disposed disc music box instrument 120. Spare disc holders 112, 112 are disposed on decorative columns 113, 113 which are formed on the back wall of the space 111. Thus, spare music box discs 101', 101' can be fitted to or removed from the spare disc holders 112, 112 quickly and easily. Besides, when the spare music box discs 101', 101' are fitted to the spare disc holders 112, 112, the spare music box discs are positioned so that their parts can be seen from outside. Thus, they are considered to be a part of decoration of the timepiece and the disc can be prevented from being lost. And, this disc music box instrument (output device) 120 uses the easily and quickly exchangeable music box discs 101 to play the music box.

The music box disc 101 used for the disc music box instrument (output device) 120 of this embodiment is made of light metal such as an aluminum material and formed into a circular plate having a predetermined rigid strength, and its back side is formed a plurality of engaging parts 103*a* for playing corresponding to the pattern of a music number. Besides, as shown in FIG. 19, the music box disc 101 is formed a circular fitting hole 102 having a predetermined diameter at its center, and a drive hole 104 which is used to drive to rotate the music box disc 101 in the neighborhood of the fitting hole 102 and at an angle position corresponding to the playing pattern.

And, the back of the music box disc 101 is divided into a plurality of tracks in the radial direction corresponding to the music box petals 127*a* of the music box sounding member 127 of the disc music box instrument 120, and the engaging parts 103*a* for playing are formed at positions in the circumferential direction corresponding to the timing of playing musical scales shared by the respective tracks. And, a predetermined playing pattern is formed by these engaging parts 103*a* for playing.

In the trick timepiece of this embodiment, the tricky device 150, which performs a series of tricky movement by using the instrument including the above-described disc music box instrument 120 on a predetermined hour, is housed within the clock body 110.

Figure 26:
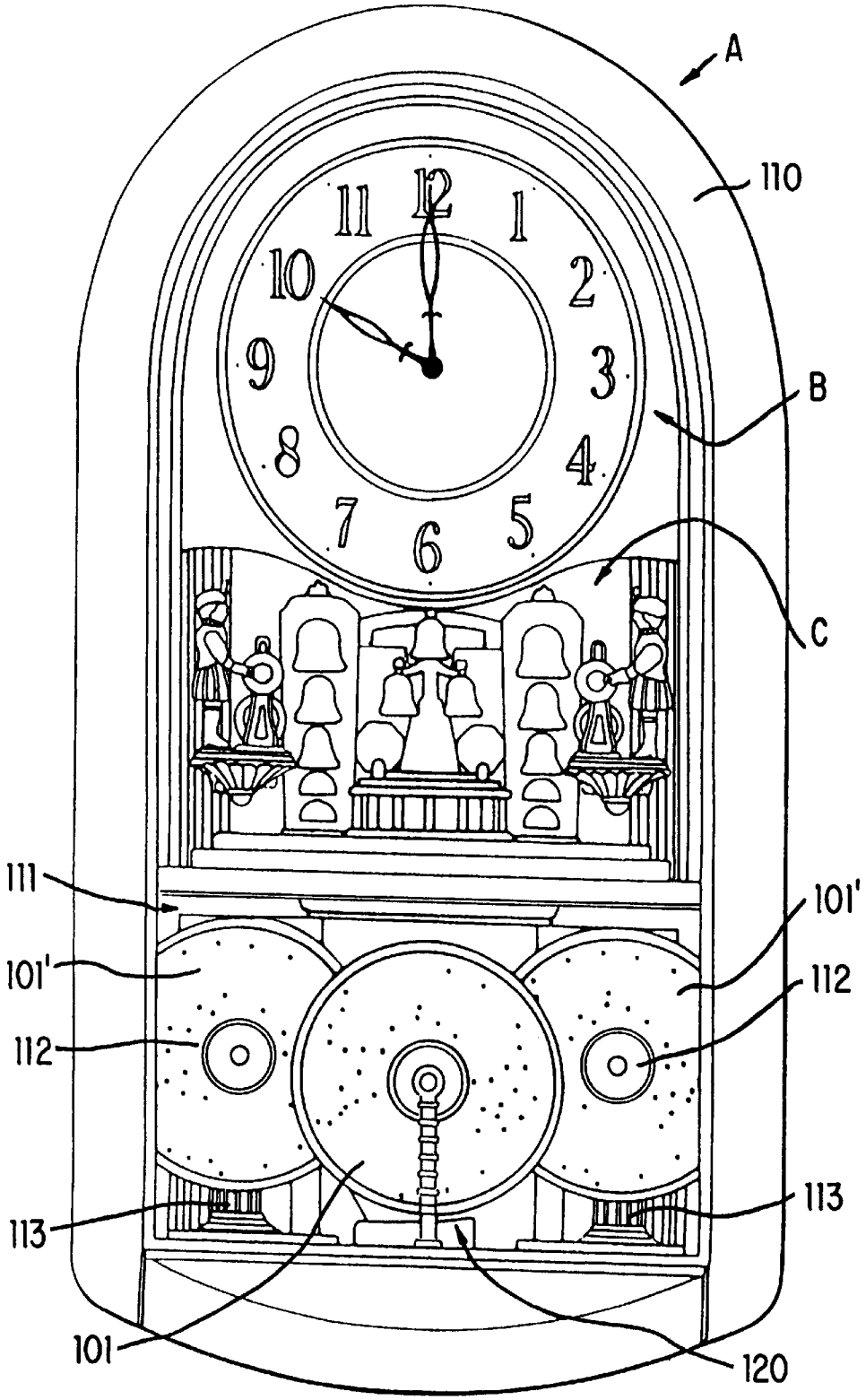
FIG. 26 is a front view showing a state of tricky motions in progress of the trick timepiece in the same embodiment.
Figure 27:
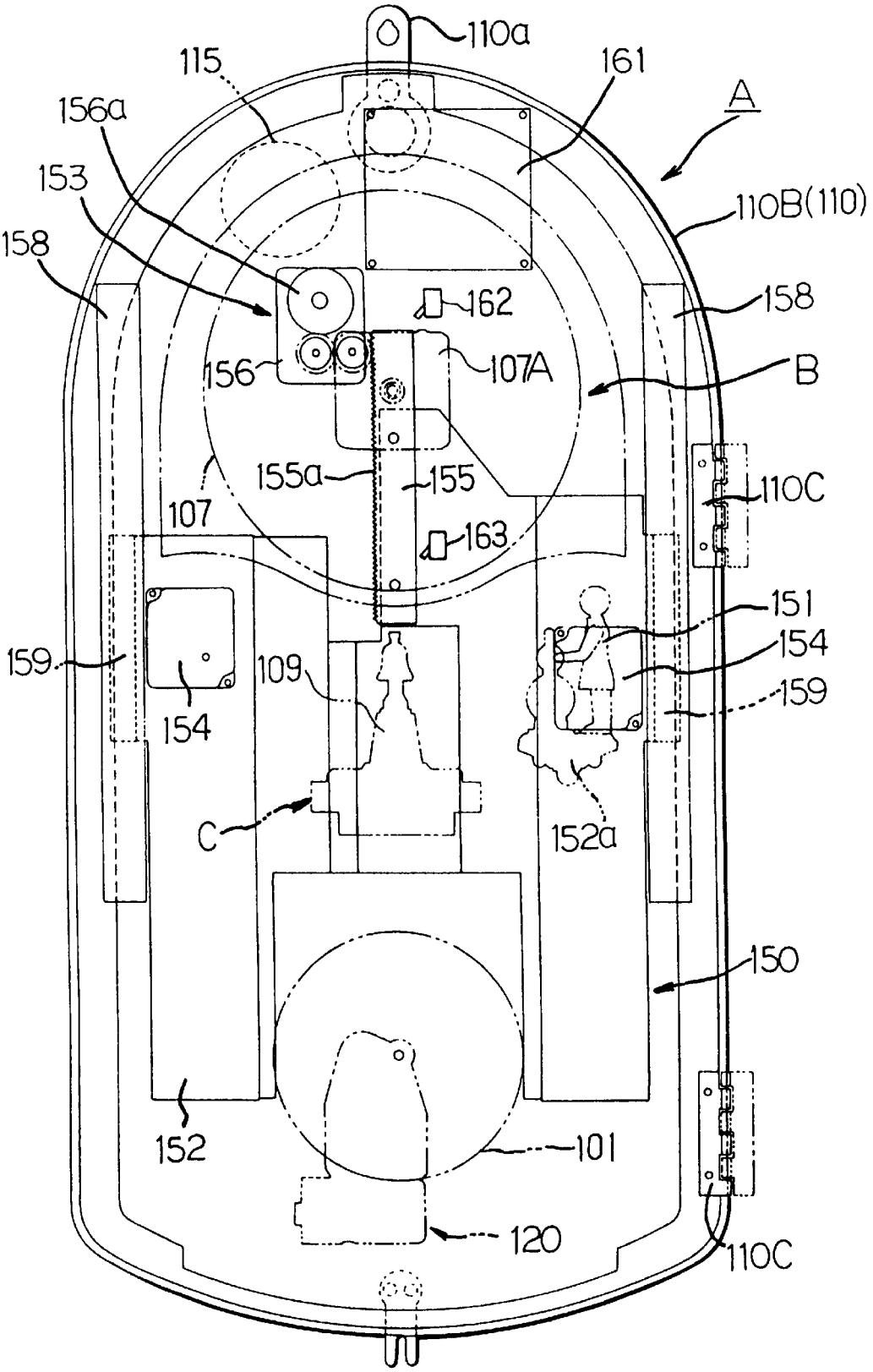
FIG. 27 is a front view showing major parts of a tricky device in operation for trick motions with a front member omitted of the trick timepiece in the same embodiment.
Figure 28:
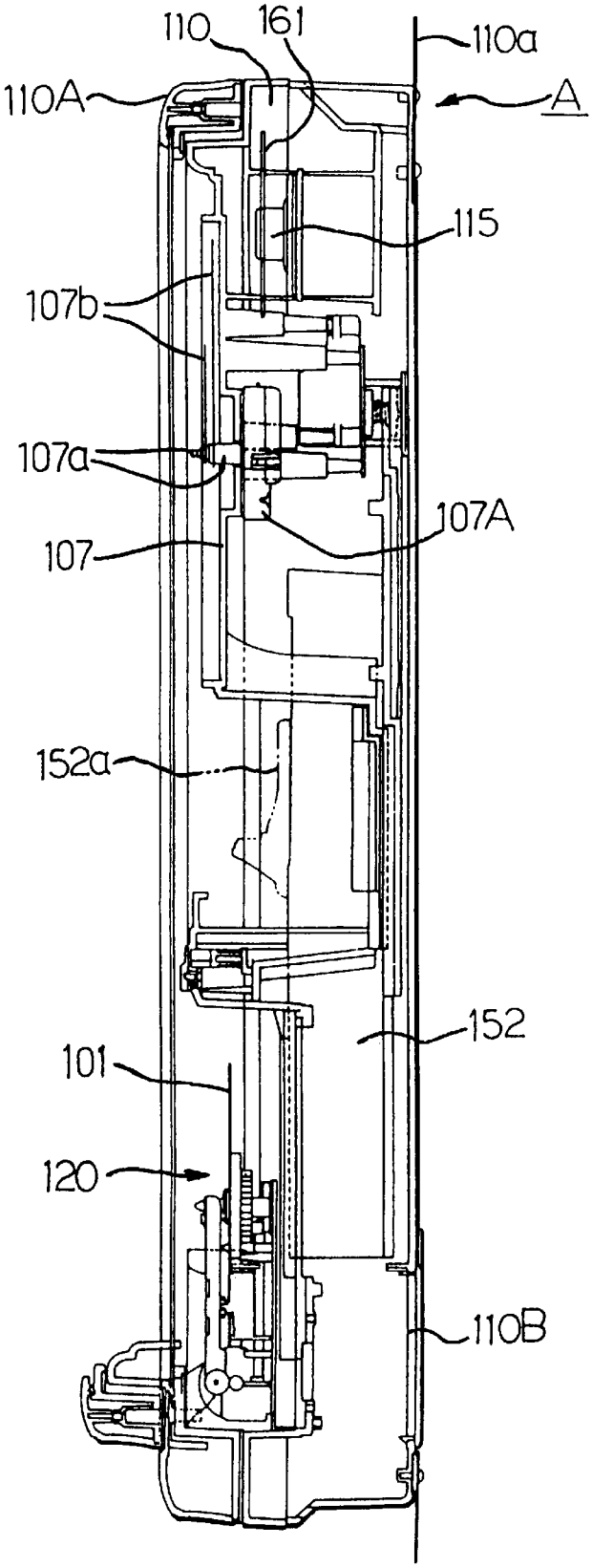
FIG. 28 is a vertical side view showing the trick motions of the trick timepiece in the same embodiment.

As shown in FIG. 26 to FIG. 28, this tricky device 150 is normally concealed behind the dial plate 107 and comprises a large stage 152 on which puppets 151 are positioned to give a tricky performance, a stage driving mechanism 153 which moves the stage 152 from the concealed position to the lower appearance position, and a control mechanism (circuit board 161) which effects the associated movement of the stage driving mechanism 153 and the disc music box instrument (output device) 120.

This stage 152 is made of a rigid plastic having a relatively high rigid strength to have a width shorter by a predetermined distance than an inner width of the clock body 110, has a recess around the turning decoration C at the middle in the breadth direction, and can be moved vertically by the stage driving mechanism 153 within the clock body 110. And, the both sides and lower part of the stage 152 are expanded downwards to provide a stable balance when the stage 152 is moved vertically.

And, the puppet 151 is positioned to give a tricky performance on both sides of the stage 152. The puppet 151 is fixed on a pedestal 152*a* disposed on either side of the stage 152, and has an independent motor drive unit 154 to give a tricky performance. Specifically, these puppets 151 are formed to have movable arms, and the leading ends of the arms are connected to a handle which is driven to rotate by the motor drive unit 154 to give a tricky performance. And, as will be described afterward, the puppets 151 are moved to give a tricky performance as if they are turning the handle to play the music box at the time of playing the music box.

The stage driving mechanism 153 comprises a rack 155 which is vertically fixed at substantially the center on the back of the stage 152, a drive unit 156 which is fixed to the clock body 110 with its output gear engaged with a rack gear 155*a* which is disposed on the rack 155, and a slider 157 which is disposed on either side of the stage 152, and can stably slide the stage 152 in a vertical direction.

Specifically, the rack 155 is formed in a substantially long plate shape having a predetermined length longer than the sliding distance of the stage 152, and has the rack gear 155*a* with a predetermined pitch formed along the overall length of one side edge. And, this rack 155 is also fixed vertically at substantially the center of the front of the stage 152, and can be moved stably in a vertical direction by the single drive unit 156.

And, the drive unit 156 is firmly fixed to the clock body 110 to correspond to the position of the rack 155 disposed on the stage 152, and its output gear is engaged with the rack gear 155*a* of the rack 155. Besides, the drive unit 156 comprises a reversible motor 156*a* and a group of reducing gears which reduces the motor's rotational output to a predetermined level and transmits to the output gear, and is electrically connected to the control mechanism, so that the motor 156*a* can be revolved in either direction according to the operation command from the control mechanism.

Therefore, when the motor 156*a* of the stage driving mechanism 153 operates to make normal rotations, the output gear makes clockwise rotations to lower the stage 152, and when the motor 156*a* makes reverse rotations, the output gear makes counterclockwise rotations to raise the stage 152.

And, the slider 157 comprises a guide member 158 provided with a guide groove (not shown) and vertically fixed to the clock body 110 and a long plate-shaped slider body 159 which is fitted with play into the guide groove and vertically fixed to the stage 152. The slider body 159 moves along the guide groove of the guide member to stably move the stage 152 vertically. Besides, these members 158, 159 are formed of a metal material, and a sliding frictional resistance between them is reduced to enable smooth sliding movement, so that the durability of the slider 157 is improved.

Besides, the above-described control mechanism comprises a control circuit mounted on the circuit board 161. This control circuit is set to perform a series of tricky movements according to the hour signal from the clock movement 107A.

This control circuit is electrically connected to a top end switch 162 for detecting that the stage 152 has reached the lower appearance position, a microswitch 43 which is an auto-stop switch for detecting one turn of the disc by the music box instrument, and a bottom end switch 163 for detecting that the stage has reached the upper concealing position; and according to the detection signals from these switches, the control circuit controls to drive a series of tricky movements including the music box's play.

The top end switch 162 is a microswitch having an ordinary rising/falling switch lever and disposed at a position where the switch lever is confronted with the side where the rack gear 155*a* of the rack 155 is not disposed and the top end of the rack 155 is not opposed when the rack 155 is at the lower position in the vertical direction.

And, the switch lever of the top end switch 162 is pushed by a spring or the like so that it stands up to be protruded from the switch body, and when it is tilted in a direction opposite from the ordinary switch, it becomes an electrically cut-off state, and when it is erected, it becomes an electrically turned-on state.

Therefore, when the stage 152, namely the rack 155, is in the upper concealed position, the rack 155 is confronted with the top end switch 162, its switch lever is fell down to cut off the switch, and the switch signal is prevented from being output. On the other hand, when the stage 152, namely the rack 155, reaches the lower appearance position, the top end of the rack 155 separates from the top end switch 162, the switch lever stands up to turn on the switch, and the on switch signal is output. And, the auto-stop switch is configured as described afterward that it detects one turn of the disc 101 by the disc music box instrument 120 and outputs the on switch signal.

Besides, the bottom end switch 163 is a microswitch having an ordinary rising/falling switch lever and set to perform the same switch operation as the top end switch 162. And, the bottom-end switch 163 is disposed at a position where its switch lever is confronted with the sideways where the rack gear 155*a* of the rack 155 is not disposed and the bottom end of the rack 155 does not oppose when the rack 155 is at the upper part in the vertical direction.

Therefore, when the stage 152, namely the rack 155, is at the lower appearance position, the rack 155 is confronted with the bottom end switch 163 to fall its switch lever to changeover, and the switch lever 43 is stood to provide a cut off state, so that the switch signal is not output. On the other hand, when the stage 152, namely the rack 155, reaches the upper concealed position, the bottom end of the rack 155 is separated from the bottom-end switch 163, the switch lever is erected to make the switch in an on state, and the on switch signal is output. Reference numeral 115 is a loud speaker which is disposed at the upper left side of the clock body 110 and connected to the control circuit to make a predetermined sounding operation.

Description will be made of the tricky movement of the trick timepiece A of this embodiment.

On a predetermined hour, an activation signal for activating the tricky movement is sent from the clock movement 107A to the control circuit, and a series of tricky movement of an instrument is performed by being controlled to move by the control circuit.

First, the stage driving mechanism 153 is activated, the motor 156*a* of the stage drive unit 156 is driven to rotate in the normal direction, and the downward movement of the stage 152 is started.

And, when the stage 152 reaches the bottom end position to appear as predetermined, the switch lever of the top end switch 162 is erected to turn on the top end switch 162, and according to the switch on signal, the lowering movement of the stage 152 is stopped, and the tricky performance of the puppet 151 and the play in actual sounds of the music box instrument 120 are started.

Specifically, the puppets 151 on both sides of the stage 152 perform as if the handles are rotated to drive the music box, and the disc music box instrument 120 is activated, so that the music box disc 101 is driven to rotate to perform the music box's play in actual sounds.

In this embodiment, a ROM may be added to the circuit board and based on play data stored in the ROM, electronic prelude and melody sounds may be produced from the loud speaker 115 while the stage 152 is lowering, although descriptions have been omitted.

And, when one turn (termination of playing one music number) of the disc is detected by the auto-stop switch, the music box's play is stopped, the tricky performance of the puppet 151 is also stopped, and the stage 152 is started to return.

Specifically, the motor 156*a* of the stage driving unit 156 is driven to rotate in the reverse direction, the stage 152 reaches the top end position where it is concealed, the switch lever of the bottom end switch 163 is erected to turn on the bottom end switch 163, and based on the switch on signal, the rising movement of the stage 152 is stopped to terminate the tricky performance.

And, in the same manner as lowering of the stage 152, an ending melody may be produced by the loud speaker 115 while rising the stage 152.

The above embodiment is configured that the stage of the tricky device is moved from the upper concealed position to the lower appearance position. This is not exclusive, and various conventional structures may be used as required. Specifically, the stage may be linearly moved from bottom to top, from left to right, or forward; the stage itself may be turned; or these may be combined.

And, it may be configured that the user can select to make the music box play on the hour by restricting the operation of the tricky device as desired.

As described above, the trick timepiece of this embodiment can give more fun to the user by incorporating the music box instrument to use the music box's play of actual sounds rich in realism as accompaniment.

Besides, since a melody as the accompaniment of the tricky movement can be changed easily by the disc exchange, various combinations can be made, and provisions can be made flexibly for the user's taste. For example, according to seasonal changes, a music number suitable for the pertinent season can be selected, or on a particular feast day, a music number for the feast day can be played.

Thus, in addition to the use as the normal timepiece, this trick timepiece can secure the sufficient appearance of a handicraft, and a high-quality appearance is provided. A commodity value can be improved, and various developments can be made as commodity.

What is claimed is:

1. A disc music box for playing a melody by rotating by a motor a disc having a plurality of engaging parts for playing and plucking music box petals by star wheels guided and turned by the engaging parts for playing, comprising:

control information for controlling other instruments to be moved in association with play of the music box recorded at desired portions on the disc excepting the portions where the engaging parts for playing are disposed on the disc; and detecting means provided in the music box for detecting the control information and outputting an electrical control signal for electrically controlling the other instruments in association with the play of the music box.

2. The disc music box according to claim 1, wherein the control information is recorded in a form of predetermined-shaped notches or unnotched portions formed on an outer periphery of the disc.

3. The disc music box according to claim 1, wherein the control information is recorded in a form of predetermined-shaped notches or unnotched portions disposed between tracks where the engaging parts for playing are formed.

4. The disc music box according to claim 1, wherein at least the record portions of the disc are formed of a material through which a predetermined quantity of light passes, and the control information is formed of the transmission portions or non-transmission portions.

5. The disc music box according to claim 1, wherein at least the record portions of the disc are formed of a material which reflects a predetermined quantity of light, and the control information is formed of the reflection or non-reflection portions.

6. The disc music box according to claim 4 or 5 wherein the detecting means for reading the control information comprises a light sensor which outputs an electric signal corresponding to the transmitted or reflected light from the control information.

7. The disc music box according to claim 5, wherein a reading part for reading the control information is formed of a light sensor which outputs a signal intensity corresponding to the transmitted or reflected quantity of light from the record portions.

8. A disc music box according to claim 1, wherein the detecting means comprises a plurality of switches each provided for one of the star wheels.

9. A disc music box according to claim 1, wherein said control information is mechanical control information.

10. A disc music box according to claim 1, wherein said control information is optical control information.

11. An animated timepiece comprises an animating device which comprises at least one of an acoustic mechanism, a visual mechanism, and an action mechanism and responds to a predetermined start signal to operate said one of mechanisms for providing a visual or acoustic effect for a predetermined time, said timepiece comprising:

a timepiece body;

a music box provided in said timepiece body;

a detachable information disc attached to said music box and having engaging parts for playing provided in playing tracks thereon;

control information provided in information tracks on said information disc for controlling said one of mechanisms;

detecting means for reading said control information to output an electrical control signal; and control means in response to said electrical control signal to control said one of mechanisms in association with play of said music box.

12. The information disc according to claim 11, wherein the playing tracks and the information tracks are alternately disposed.

13. An output device for the animated timepiece according to claim 11, which comprises:

a sounding mechanism to obtain playing information of the information disc to operate to produce sounds and a contact mechanism to obtain control information of the information disc to output, wherein the sounding mechanism plays a melody by plucking music box petals of a music box sounding member by the star wheels which are guided to rotate by the engaging parts for playing; and the contact mechanism is operated to contact by the star wheels which are guided to rotate by engaging parts for playing.

14. The output device according to claim 13, wherein the sounding mechanism and the contact mechanism are symmetrically disposed with respect to an information disc rotational axis.

15. An output device for the animated timepiece according to claim 11, wherein a separate sounding mechanism is incorporated into a portion of a contact mechanism.

16. An animated timepiece according to claim 11, which further comprises:

an animating device which performs action and disposed within said clock body, wherein said disc music box to which information disc is detachably fitted is disposed, and means for interconnecting the action of the animating device with the play of the disc music box.

17. The animated timepiece according to claim 16, which further comprises a switch which is turned on or off by rotation of the information disc to provide an on or off signal by which the action of the animating device is controlled.

18. An animated timepiece according to claim 11, wherein said control information is mechanical control information.

19. An animated timepiece according to claim 11, wherein said control information is optical control information.

* * * * *